US007040827B2

(12) United States Patent
Gueret

(10) Patent No.: US 7,040,827 B2
(45) Date of Patent: May 9, 2006

(54) DEVICE AND METHOD FOR APPLYING AND/OR PACKAGING A PRODUCT

(75) Inventor: Jean-Louis H. Gueret, Paris (FR)

(73) Assignee: L'Oreal S.A., Paris (FR)

( * ) Notice: Subject to any disclaimer, the term of this patent is extended or adjusted under 35 U.S.C. 154(b) by 0 days.

(21) Appl. No.: 10/304,084

(22) Filed: Nov. 26, 2002

(65) Prior Publication Data

US 2003/0123919 A1 Jul. 3, 2003

Related U.S. Application Data

(60) Provisional application No. 60/346,760, filed on Jan. 9, 2002.

(30) Foreign Application Priority Data

Nov. 26, 2001 (FR) ..... 01 15260

(51) Int. Cl.
*A45D 33/00* (2006.01)
*A46B 11/00* (2006.01)
*A46B 11/02* (2006.01)

(52) U.S. Cl. ..... 401/130; 401/126; 401/188 R; 401/47

(58) Field of Classification Search ..... 401/126, 401/127, 130, 200, 123, 124, 125, 192, 188 R, 401/47
See application file for complete search history.

(56) References Cited

U.S. PATENT DOCUMENTS 2,296,761 A 9/1942 Beckers
2,365,921 A * 12/1944 Vaughn ..... 401/192
3,619,843 A * 11/1971 Richter et al. ..... 401/200 X
4,037,977 A * 7/1977 Ronai ..... 401/209
4,690,825 A * 9/1987 Won ..... 424/501
5,167,709 A * 12/1992 Shinohara et al. ..... 106/504
5,393,809 A 2/1995 Gueret (Continued)

FOREIGN PATENT DOCUMENTS

CN 1309069 A 10/2001
CN 1300701 A 9/2003
DE 4037821 A1 6/1992
DE 4335633 10/1994

(Continued)

OTHER PUBLICATIONS

English language Derwent Abstract of EP 1 043 018, Oct. 11, 2000.

(Continued)

*Primary Examiner*—David J. Walczak
(74) *Attorney, Agent, or Firm*—Finnegan, Henderson, Farabow, Garrett & Dunner, LLP

(57) ABSTRACT

A device for at least one of applying a product to a surface and packaging a product may include at least one element that may include at least one substance, and at least one of the product and the surface receiving the product may be enabled to contact the at least one substance. Alternatively, or in addition, the at least one element may generate at least one of an electric field and a magnetic field, and at least one of the product and the surface may be enabled to be subjected to the field generated by the at least one substance. Other devices as well as methods are also disclosed.

77 Claims, 16 Drawing Sheets

U.S. PATENT DOCUMENTS

| | | | | |
|---|---|---|---|---|
| 5,549,915 | A | 8/1996 | Volkonsky et al. | |
| 2001/0031168 | A1 | 10/2001 | Gueret | |
| 2001/0033766 | A1* | 10/2001 | Gueret | 401/130 |

FOREIGN PATENT DOCUMENTS

| | | |
|---|---|---|
| EP | 1 043 018 | 10/2000 |
| EP | 1129640 | 9/2001 |
| FR | 2 607 685 | 6/1988 |
| GB | 2318778 | 5/1998 |
| JP | 5-74412 | 10/1993 |
| JP | 6-7608 | 2/1994 |
| JP | 3048533 | 5/1998 |
| JP | 11-4713 | 1/1999 |

OTHER PUBLICATIONS

French Preliminary Examination Report, dated Jul. 2, 2004.
Patent Abstract of Japan, Publication No. 09020350, Jan. 21, 1997 (1 page).
Official Office Action issued by the Japanese Patent Office on Dec. 22, 2004, in JP 2002-382699.
English-language translation of the Official Office Action Issued Dec. 22, 2004, in JP 2002-382699.
English-language Abstract of FR 2 607 685.
First Office Action issued by the Chinese Patent Office for Chinese Application No. 02152877.2, on Feb. 4, 2005.

* cited by examiner

DEVICE AND METHOD FOR APPLYING AND/OR PACKAGING A PRODUCT

This application claims the benefit of priority under 35 U.S.C. § 119(e) of U.S. provisional application No. 60/346,760, filed Jan. 9, 2002.

The present invention relates to a device for applying a product, such as, for example, a cosmetic product (e.g., make-up) and/or a care product, to the skin, hair, eyelashes, fingernails, and/or toe nails. For example, the device may be used to apply cosmetic products such as those defined in Counsel Directive 93/35/EEC (European Economic Community) dated Jun. 14, 1993, which provides merely one example of a definition of cosmetic products and should not be considered as limiting.

Examples of devices for packaging and/or application are described U.S. Patent Application Publication No. US 2001/0031168, U.S. Pat. No. 5,393,809, and European Patent Application No. EP 1 043 018.

In the following description, certain aspects and embodiments will become evident. It should be understood that the invention, in its broadest sense, could be practiced without having one or more features of these aspects and embodiments. It should be understood that these aspects and embodiments are merely exemplary.

In one aspect, as embodied and broadly described herein, the invention includes a device for applying a product to a surface and/or packaging a product. The device may include at least one element that may include at least one substance, and at least one of the product and the surface receiving the product may be enabled to contact the at least one substance. Alternatively, or in addition, the at least one element may generate at least one of an electric field and a magnetic field, and at least one of the product and the surface may be enabled to be subjected to the field generated by the at least one element.

In a further aspect, the at least one element may include a plurality of particles and a portion permeable to the product. The portion may at least partially define a hollow structure including an inner space configured to retain the plurality of particles, and the at least one element may be configured such that the plurality of particles includes the at least one substance. An interior surface of the hollow structure may contact at least some of the plurality of particles. In some examples, the volume defined by the plurality of particles may be greater than the volume defined by the portion. Some examples may be configured so that at least some of the plurality of particles may contact each other.

According to another aspect, the device may include at least one element containing at least one substance, wherein the element may be configured to enable the product (e.g., a fluid product) to be contacted with the substance.

In yet another aspect, a device may include at least one element configured to generate a magnetic field and/or an electric filed, wherein the at least one element may be configured to enable the product to be exposed to the field generated by the element.

The term "product" includes fluids such as, for example, liquids, powders, and/or gels.

The substance may be held in the solid state in the at least one element, for example, in the form of particles, at least prior to the at least one element contacting the product.

The term "particles" includes crystals and bodies having all sizes and shapes, for example, elongate shapes, having compositions that may be homogeneous or heterogeneous, and possibly being hollow or solid. For example, particles may have a size ranging from about 0.1 micrometer to about 7 millimeters, for example, ranging from about 2 micrometers to about 3 millimeters, for example, ranging from about 10 micrometers to about 1 millimeter (e.g., ranging from about 50 micrometers to about 500 micrometers).

Exemplary devices including at least one element that generates at least an electric field may be configured in a number of different forms. For example, such an element may include a material comprising ions that exhibit an electrical field. Alternatively, or in addition, the element may include a material that may be electrostatically charged.

According to another aspect, the substance may be released by diffusing into the product from particles that may be retained within the at least one element. When the substance present in the at least one element is configured to contact the product, for example, the substance may include at least one compound having a mineral, vegetable, and/or animal origin. The substance may optionally include magnetic properties (e.g., it may be magnetized and/or magnetizable).

In another aspect, the at least one substance may be configured to cause one of a catalytic reaction, an enzymatic reaction, and a modification of a composition of the product. For example, the at least one substance may act on the product while the product is being dispensed, and/or during a period of storage, for example, in a receptacle of the device.

According to another aspect, the device may be configured such that the at least one substance exerts at least one of an electrical field and a magnetic field on the product while the product is being dispensed.

In another aspect, the at least one substance may be configured to diffuse into the product. For example, the at least one substance may be configured to include an ionic form at least once it has diffused into the product.

According to yet another aspect, the at least one substance may exhibit properties selected from at least one of purifying properties, antiseptic properties, blood circulation encouraging properties, regenerative properties, and healing properties (e.g., pain relieving properties, and/or relaxing properties). For example, the at least one element may include properties other than biocidal properties.

The term "purifying properties" means that the at least one element may be suitable for picking up compounds that may be considered to be impurities and/or undesirable. The at least one element may thus have particles of carbon, for example, which may be suitable for adsorbing certain compounds. For example, the at least one element may thus serve to prevent impurities that may be included in the product from reaching an application surface, and/or for preventing impurities that may be included on the application surface from reaching the supply of product. For example, the at least one element may be configured to act as a filter.

In an additional aspect, the at least one substance may include at least one material selected from metals, metal alloys, cobalt, barium, chromium, aluminum, silver, copper, titanium, bronze, manganese, metal oxides, iron oxides, ferrites, silicates, sulfates, barium sulfates, carbonates, calcium carbonates, non-ferrous compounds, sulfur, magnesium, calcium, boron, potassium, carbon, oligoelements, sea salts, rock salts, clays, steatites, algaes, extracts of algaes, planktons, extracts of planktons, roots, licorices, gingers, waxes, oils, bactericides, vitamins, proteins, acids, hormones, collagens, alums, alum stones, silks, hemps, and glucoses.

According to a further aspect, the at least one substance may contact at least one of a substrate and a binder including at least one material selected from silicas, coloidal silicas, sands, aluminas, steatites, sandstones, titanium oxides, zirconium oxides, glasses, ceramics, woods, corks, wood fibers, cork fibers, wood powders, cork powders, corns, maizes, wheat fibers, rice fibers, lavas, silicates, galenas, oxides, hemps, flaxes, silks, clays, porcelains, micas, polymers, thermoplastics, thermosetting polymers, PEs, PETs, PUs, PVCs, PAs, EVAs, vinyls, urea formaldehydes, epoxies, polyesters, cyanoacrylates, and elastomers.

In yet another aspect, the at least one element may be configured in the form of an applicator for the product. For example, a portion of the at least one element may define a substantially convex surface (e.g., having the form of a dome).

According to an additional aspect, the at least one element may be configured to be permeable to the product. For example, the product may be contained in a receptacle and the at least one element may be configured so that product taken from the receptacle passes through the at least one element when the device is in use. For example, a portion permeable to the product may define at least one passage configured to pass the product therethrough, wherein the particles define a size dimension sufficient to prevent the plurality of particles from traveling through the at least one passage. For example, the at least one element may be configured so that substantially all of the product leaving the receptacle passes therethrough.

In still another aspect, the device may be configured in the form of a single use device, wherein the at least one element may be configured to be loaded with a single dose of the product, and wherein the device may be configured to dispense the single dose.

According to another aspect, the element may include fibers containing at least a portion of the substance. For example, the device may be configured in the form of at least one of a brush for applying mascara, a comb for the hair, a comb for applying a product to the eyelashes and/or eyebrows, a hairbrush, a toothbrush, a brush, a tip (e.g., a flocked tip) for applying a product to the nails and/or the lips, and a powder puff.

In another aspect, the at least one element may include a piece of sintered material, a ceramic, a felt, a foam, a sponge, a woven cloth, and/or non-woven cloth.

In yet another aspect, the at least one element may be pre-impregnated with the product prior to use.

In still another aspect, the at least one element may be permanently coupled to a receptacle. Alternatively, it may be configured so as to be capable of being removably coupled to the receptacle. Removably coupling the at least one element on a receptacle may enable the at least one element to be selected as a function of the action to be performed by the at least one element on the product and/or on the surface that is to receive the product. A removable coupling may render it possible to separate the at least one element from the receptacle, for example, in order to perform one or more applications during the day (e.g., with the at least one element being carried in, for example, a handbag).

According to another aspect, the device may include a reservoir and a product contained in the reservoir. For example, the at least one element may be configured to be removably coupled to the reservoir, for example, via at least one of snap-fastening, screw-fastening, adhesives, and heat-sealing. According to an additional aspect, the at least one element may be coupled to a closure capsule for the receptacle. For example, the closure capsule may have a skirt, wherein the closure capsule may be configured to close the reservoir and the at least one element may be coupled to the skirt.

In another aspect, the at least one element may include a tube through which the product may flow. For example, the at least one element may be configured such that product from the reservoir may pass through the at least one element when the device is used.

According to one aspect, the product may include at least one of a cosmetic product and a care product. For example, the cosmetic product may be in the form of at least one of a liquid, a powder, a gel, a cream, an aqueous solution, an alcohol solution, an oil, and an emulsion.

According to an additional aspect, a method for at least one of applying a product to a surface and packaging a product may include providing the device and at least one of causing at least one of the product and a surface receiving the product to contact the at least one substance, and causing at least one of the product and a surface receiving the product to be subjected to the field generated by the at least one element.

The term "providing" is used in a broad sense, and refers to, but is not limited to, making available for use, manufacturing, enabling usage, giving, supplying, obtaining, getting a hold of, acquiring, purchasing, selling, distributing, possessing, making ready for use, forming and/or obtaining intermediate product(s), and/or placing in a position ready for use.

In a further aspect, a method of manufacturing the device may include forming the at least one element and removing material from the surface of the at least one element such that some of the particles are exposed. For example, removing material from the surface of the at least one element may include rotating the at least one element and an abrasive agent in a drum.

In yet another aspect, the at least one element may include a piece of sintered material. For example, the at least one element may include particles of a material that may be at least one of thermoplastic, thermoset, inorganic, for example, particles including at least one of ceramics, metals, and metal oxides.

The at least one element may be formed from (e.g., partially or entirely) a ceramic that may be formed from a material that includes at least some of the substance. The at least one element may include a foam formed from a material containing at least some of the substance.

According to another aspect, the at least one element may include a foam and/or a sintered piece loaded with a material containing the substance and/or within which particles containing the substance may be included. The particles may be held in the foam and/or the sintered piece via binder (e.g., an adhesive).

In yet another aspect, the at least one element may include at least one cavity that may be visible to the naked eye and may enable an exchange surface area with the product to be increased. For example, when the product is to pass through the at least one element, the at least one element may include channels of, for example, non-rectilinear shape so as to increase the time taken by the product to pass through the at least one element. For example, the at least one element may include a pellet having holes in each of its faces, wherein the holes may be slightly offset so as to form baffles for passing the product. The surface area of the at least one element that may be exposed to the product may be increased. The at least one element may be in the form of a tube through which the product flows in use.

In another aspect, the device may include an applicator and the at least one element may be configured to wipe the applicator. For example, the at least one element may act on a quantity of product absorbed by the applicator.

According to another aspect, the portion permeable to the product may include at least one wall that is permeable to product. The at least one wall may be at least one of rigid, and flexible.

According to an additional aspect, the particles may include at least one bead. For example, the at least one bead may be compressible. Alternatively, or in addition, device may include at least one bead, and the at least one bead may include at least one of the particles. For example, the at least one bead may be compressible. By compressing, for example, the particles to a greater or lesser extent, the compressible particles may render it possible to modify any empty space between them, and to modify the head loss associated with passing through the at least one element and/or the quantity of product that may be present between the particles.

According to still another aspect, at least one of the particles may be free in the inner space at least partially defined by the portion of the at least one element.

According to yet another aspect, the portion of the at least one element may include a sachet and/or a cartridge configured to retain the particles, and the particles may be free inside the sachet and/or the cartridge.

In an additional aspect, the at least one element may include a surface configured to apply the product to at least one of skin, hair, finger nails, and toe nails. The surface, for example, may be flocked.

In another aspect, the device may include a handle member that may be coupled to the at least one element. For example, the device may include a reservoir configured to contain the product, wherein the handle member may be configured to be coupled in a substantially leak-tight manner to the reservoir.

According to an additional aspect, the at least one substance may be in a solid state in the at least one element at least prior to the at least one element contacting the product.

In yet another aspect, the particles may define a size ranging from about 0.1 micrometer to about 7 millimeters, for example, the particles may have a largest dimension ranging from about 5 millimeters to about 40 millimeters, for example, ranging from about 10 millimeters to about 20 millimeters.

In still another aspect, at least one of the particles may include a hollow particle at least partially filled with the at least one substance.

According to an additional aspect, at least one of the particles may include a coated particle that may have a core including a first material and a covering extending substantially around the core and comprising a second material, wherein the first material differs from the second material. For example, the covering may include the at least one substance (e.g., a surface of the covering includes the at least one substance). In some aspects, the core may include the at least one substance.

In yet another aspect, the at least one substance may be configured to exert at least one of an electric field and a magnetic field on the product.

In still another aspect, the at least one element may include a body, for example, a spherical body, that may be coated with a covering that may include the substance.

According to an additional aspect, the at least one element may be configured to serve as a product stirrer.

In a further aspect, the device may include a reservoir configured to contain the product and a product delivery orifice, wherein the device may be configured to hold the at least one element against the product delivery orifice so as to substantially close the reservoir.

According to another aspect, the inner space may be configured to contain a supply of the product. For example, the inner space may be configured to contain substantially all of the product that is to be used.

In another aspect, the device may include at least one housing configured to be free of the product and contain the at least one element while not in use. The at least one element may, for example, occupy the housing in full or in part.

According to an additional aspect, the device may include a closure member configured to close the at least one housing in a substantially hermetic manner with the at least one element contained in the at least one housing. The closure member may, for example, be configured so as to serve as a handle member. The housing into which the at least one element containing the product can be introduced, may, for example, contain particles possessing electrical properties and/or magnetic properties.

In an additional aspect, the device may include a reservoir configured to contain the product, wherein the at least one element may be configured to define a housing configured to receive an applicator element and may be in flow communication with the reservoir. For example, the at least one element may be configured to define a seat configured to bear against an applicator element.

According to another aspect, the device may include a cup having an end wall, wherein the at least one element may be located at the end wall of the cup (e.g., the bottom of the cup). According to some aspects, the cup may serve as a member for closing the receptacle, and the product may be delivered (e.g., via pouring) into the cup, for example, at the time of use.

In another aspect, the element may include and/or be constituted by at least one sheet. The at least one sheet may include at least one layer of a matrix in which the substance may be incorporated. The at least one sheet may include at least one layer of woven cloth and/or non-woven cloth. The at least one sheet may be cut so as to form, for example, a patch and/or a mask. The at least one sheet may form all or part of a hollow body that may define an inner space configured to receive a portion of the body, for example, the sheet it may form at least one of a glove, a hood, and a cap.

In yet another aspect, the device may include at least two elements that may each contain a substance, wherein the substances contained in at least two of the elements may be different.

According to another aspect, the product may include a liquid, a gel, a cream, a powder, and/or a product in the form of an extrudable stick. The product may be a cosmetic product and/or it may serve as a solvent for a cosmetic product. In some aspects, the device may include a product that may be suitable, for example, for dispersing in contact with a liquid. The liquid may include, for example, water, an alcohol, an oil, a gel, and/or an emulsion.

In still another aspect, the product may be configured to create electrically-conductive bridges and/or bridges that may be permeable to a magnetic field that may exist between particles of the at least one element.

In another aspect, the device may include an applicator for a product, for example, a cosmetic product, wherein the applicator may include at least one housing containing particles and at least one wall that may be permeable to the product. The wall may enable the product present outside the housing and in contact with the wall to be absorbed by the particles inside the housing, for example, via capillarity.

According to another aspect, the particles may be substantially inert relative to the product and may need not release any substance via diffusion on contact with the product. For example, the particles may include, for example, a powder of an inert material, and/or beads of glass and/or ceramic. The particles may be free in the housing. The particles may be configured to exert a physical and/or chemical action on the product. For example, the particles may be configured to release a substance into the product and/or to exert an electric field and/or a magnetic field on the product.

According to yet another aspect, when it is desired to exert an effect on the product by causing the product contact a given substance, it may possible, for example, to use particles, such as beads, that may be partially and/or completely covered with the substance. When it is desired to exert a magnetic field on the product and/or on the surface onto which the product is applied, it may be possible, for example, to use coated magnetic particles (e.g., magnetized and/or magnetizable particles).

In still another aspect, the housing containing the particles may be removable from a receptacle containing the product. For example, the user may have a series of housings containing particles having differing types and may use them selectively. The product may be treated in differing manners, for example, depending on the type of particles may be used. The product may thus have different effects during and/or after application to the skin, the nails, and/or the hair.

According to an additional aspect, the device may include a cartridge having at least one inlet for a product, for example, a cosmetic product, and the inlet may be configured to at least temporarily be in flow communication with a receptacle containing the product. The product may be delivered via the cartridge, for example, after passing through a housing in the cartridge containing at least one element including a substance configured to be contacted with the product and/or for exerting a magnetic field and/or an electric field on the product. For example, the element may include a foam, a sintered piece, a ceramic, and/or a plurality of particles, for example, beads (e.g., suitable for releasing the substance on contact with the product). The cartridge may include an application surface configured to be fed with the product contained in the cartridge. The application surface may include, for example, flocking. The application surface may be defined by a porous member, such as, for example, a foam, a sintered piece, a ceramic, and/or a felt.

According to another aspect, the device may include particles in the form of beads, for example, ceramic beads and/or beads including a ceramic core having a covering around the core formed from a material selected for its properties with respect to the product and/or the surface on which the product is to be applied, for example, a metal deposited on the core. The particles may be retained within the device while being configured to, for example, release a substance on contact with the product and/or to exert a magnetic field and/or an electric field on the product and/or on the surface onto which the product is to be applied.

In another aspect, the device may include at least one wall that may be permeable to the product, wherein the at least one wall may include at least one opening configured to have the product pass therethrough, for example, when the product is taken from a reservoir containing the product. The opening may include two or more blind holes that may be offset so as to form a baffle. The wall may be formed from a sintered and/or cellular material, for example, a ceramic, and the material may contain a given substance, wherein the product is suitable for contacting the substance on passing through the wall. The wall may include particles configured to exert an electric field and/or a magnetic field on the product. The wall may be formed, for example, by injecting a plastic material, by rotational molding, and/or by forming a powder and then firing the powder to make a ceramic.

In yet another aspect, the device may include an applicator for a product, for example, a cosmetic product, which may include a product reservoir and at least one wall permeable to the product that may be formed from, at least in part, a sintered and/or other porous material (e.g., a foam and/or a ceramic material), and may contain a substance (e.g., in a solid state) in the form of particles. The product may be configured to contact with the substance on passing through the wall. The substance may be configured to exert an action on the product. For example, the wall may include particles that may be configured to exert a magnetic field and/or an electric field on the product as it passes through the wall.

According to yet another aspect, the device may include a cartridge configured to be fixed on a receptacle containing a product, for example, a cosmetic product. The cartridge may contain particles (e.g., captive beads) and the product may be configured to contact the particles. The cartridge may be configured to be releasably fastened to the receptacle, and the particles may be contained in a substantially closed space in the cartridge, for example, when the cartridge is withdrawn from the receptacle. The cartridge may include, for example, a flap that may be suitable for opening when the product is introduced into the cartridge, and the product may be taken from the receptacle. Such a flap may be configured to close the space containing the particles in a substantially hermetic manner, for example, when the removable unit is withdrawn from the receptacle.

In still another aspect, the device may include an element configured to be inserted into a receptacle containing, for example, a cosmetic product. The element may include captive particles and may be configured to enable the product to come into contact therewith when the element is in the receptacle. For example, the particles may be beads of ceramic coated in a substance.

According to another aspect, the device may include at least one element including particles (1) that may contain a substance, wherein the element may be configured to enable the product and/or a surface that is to receive the product to contact the substance; and/or (2) that may contain a substance configured to generate a magnetic field and/or an electric field, wherein the element may be configured to enable the product and/or the surface to be in the field generated by the at least one element.

In yet another aspect, the particles may contain the substance and may be held together by a binder.

In still another aspect, the at least one element may include first particles containing the substance and second particles not containing the substance, wherein the first and second particles may be agglomerated by a binder. For example, the particles containing the substance may be coated particles. For example, each first particle may include a core of a first material and a covering of a second material that may differ from the first material. The covering may extend around the core, covering it completely or partially. The material of the core may be selected, for example, in such a manner as to exert a magnetic field and/or an electric field on the product and/or the surface that is to receive the product. A substance that is to be released into the product may be contained in the core and/or in the covering. Alternatively, the substance may be present solely at the surface of the covering. Coated particles may be used, for example, when the covering material is expensive.

According to another aspect, the at least one element may include at least one porous layer, wherein the at least one porous layer may be permeable to the product and may comprise the particles. For example, the at least one porous layer may include a mixture of particles having differing characteristics, wherein at least some of the mixture of particles include the at least one substance. The at least one porous layer, for example, may include a mixture of particles having different sizes.

According to another aspect, the particles of the at least one porous layer may be agglomerated by a binder. For example, the binder may include a polymer binder. According to some aspects, the binder may be one of organic and inorganic. The binder may be inorganic, for example, when the particles are incorporated in a ceramic. The binder may be organic, for example, when the particles may be dispersed in, for example, a thermoplastic and/or a thermosetting polymer. The binder may be a cement and/or a liquid, for example, an oil. The particles may be, for example, dispersed in the binder.

In an additional aspect, the device may include two layers that may include a material configured to be permeable to the product, wherein the at least one porous layer may be positioned between the two layers.

According to another aspect, the element may include a porous layer containing the substance, which may be situated between two porous layers, and at least one of the layers may include, for example, a sintered piece.

In a further aspect, the at least one element may include a body coated by a covering having at least one layer comprising the at least one substance. For example, the at least one layer may include a binder and the at least one substance. The at least one layer may, for example, include particles comprising a second substance. The body may include a material configured to exert at least one of an electrical field and a magnetic field on the product.

In another aspect, the element may include a body (e.g., a body including clay) substantially coated with a covering that may include at least one layer containing the substance. The layer may include, for example, at least one binder along with particles that may contain the substance. The layer may include other particles, for example, particles containing a second substance for exerting an action on the product. The material of the body may be configured such that the body exerts a magnetic field and/or an electric field on the product.

In an additional aspect, the at least one element may define one of a ring, a shutter, a tube, a polyhedron, a parallelepiped, and sphere.

In another aspect, the at least one element may define at least one hole.

In an additional aspect, at least one of the particles may be electrically conductive. For example, some (or each) of the particles may include an electrically insulating core, an electrically conductive covering, and an intermediate layer therebetween configured to confer electrical conduction properties to the core, for example, so as to enable the covering material to be deposited on the core via an electrochemical method, for example, when the covering is a metal.

In a further aspect, at least one of the particles may be configured to generate a magnetic field.

According to another aspect, the particles may include a core formed from a metal and/or one or more metal oxides, for example, magnetized and/or magnetizable oxides (e.g., ferrites) coated in a covering that may be magnetized and/or magnetizable. The covering may serve, for example, to prevent the core from contacting the product.

In an additional aspect, the device may at least partially include a transparent material configured to enable a user to see the at least one element when the device is closed.

In yet another aspect, the device may include a reservoir configured to contain the product and a valve member that may be configured to selectively inhibit flow communication between the reservoir and the at least one element.

Aside from the structural and procedural arrangements set forth above, the invention could include a number of other arrangements, such as those explained hereinafter. It is to be understood, that both the foregoing description and the following description are exemplary.

The accompanying drawings are incorporated in and constitute a part of this specification. The drawings illustrate exemplary embodiments of the invention and, together with the description, serve to explain some principles of the invention. In the drawings, FIG. 1 is a schematic section view of an embodiment of a device for applying and/or packaging a product;

Figure 93:
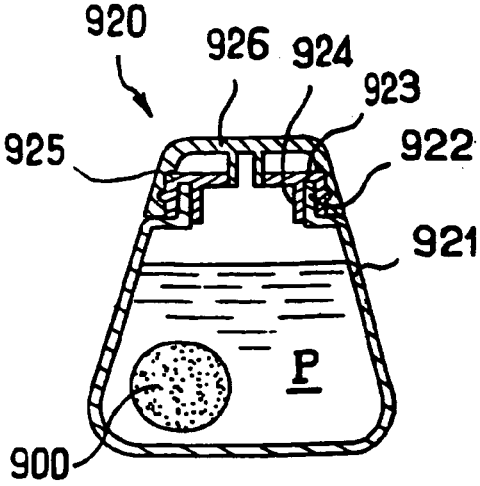
Figure 94:
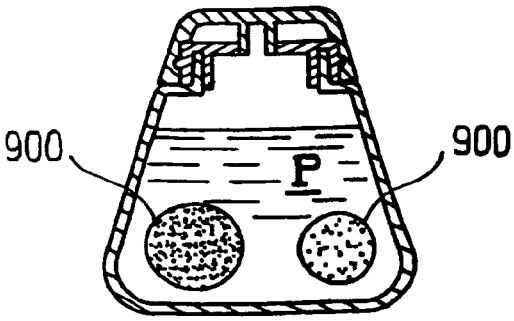
Figure 95:
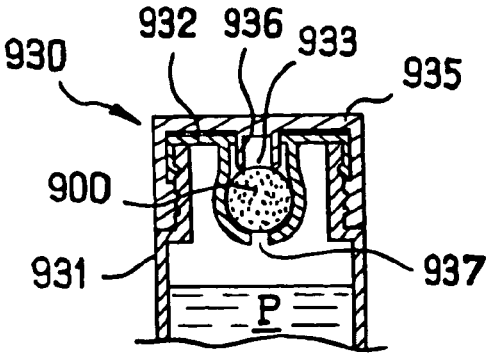
Figure 96:
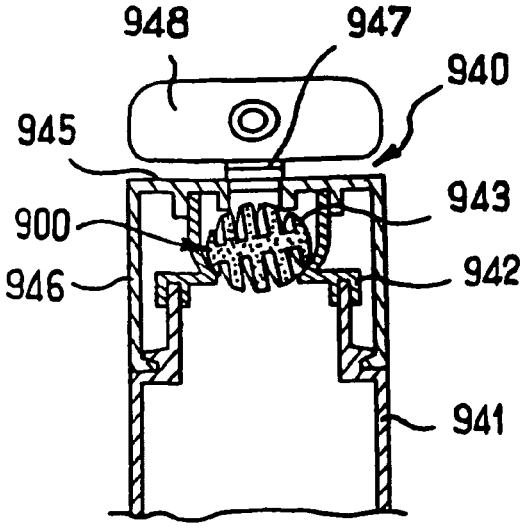
Figure 98:
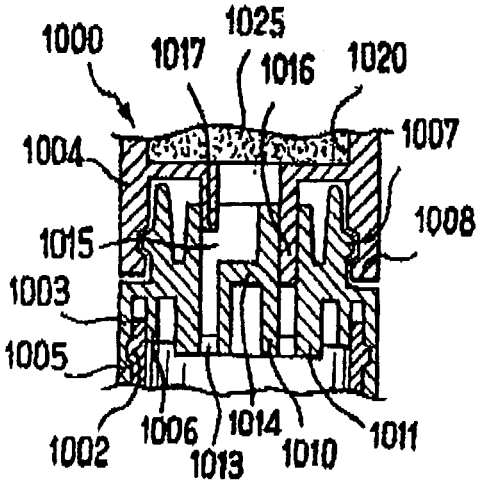
Figure 97:
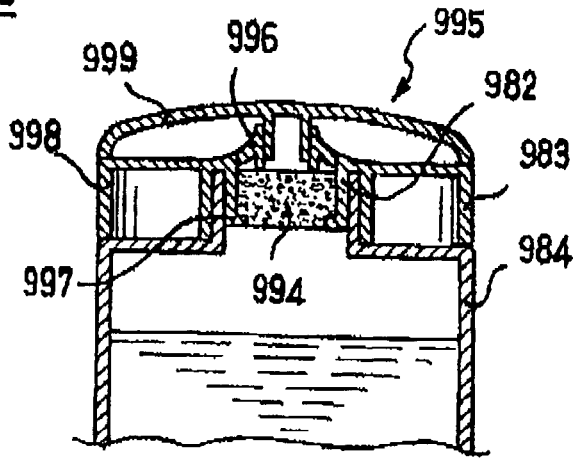
Figure 75:
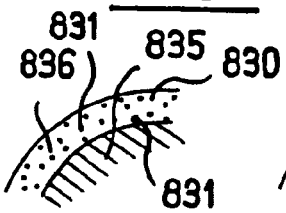
Figure 76:
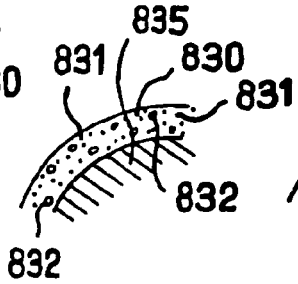
Figure 77:
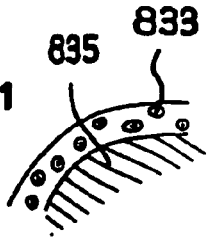
Figure 78:
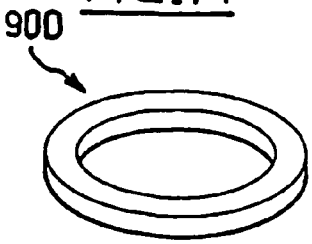
Figure 79:
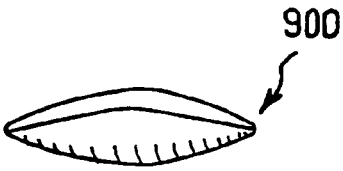
Figure 80:
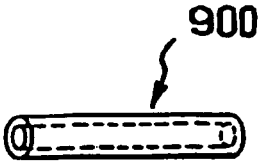
Figure 81:
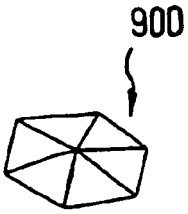
Figure 82:
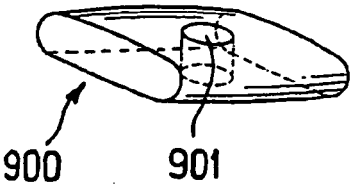
Figure 83:
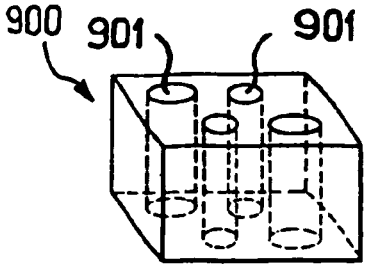
Figure 84:
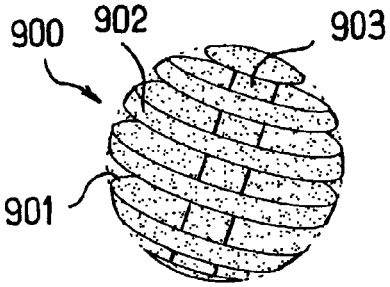
Figure 85:
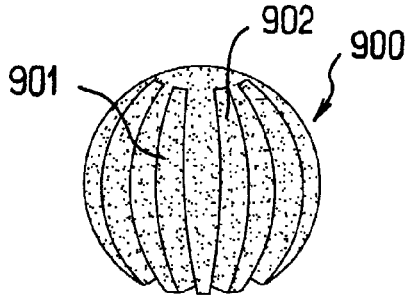
Figure 86:
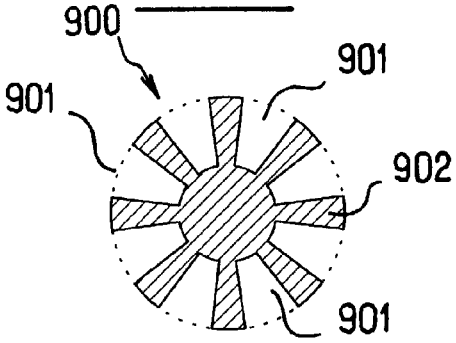
Figure 87:
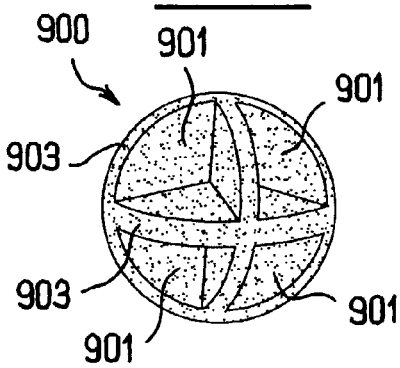
Figure 88:
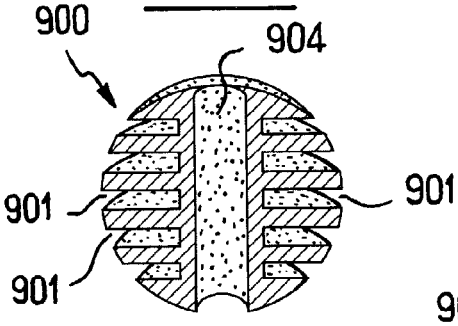
Figure 89:
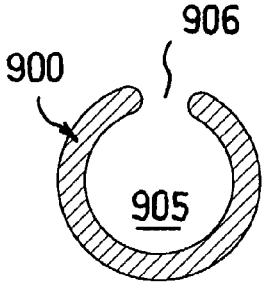
Figure 90:
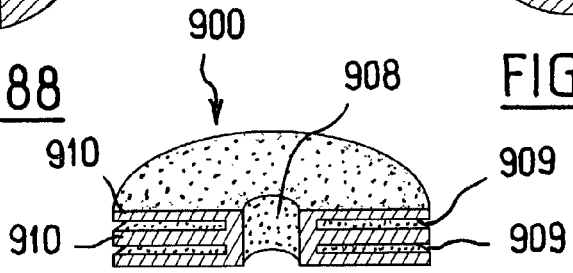
Figure 91:
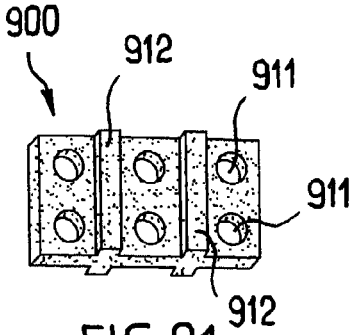
Figure 92:
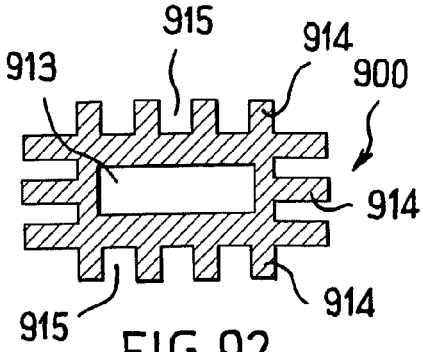

FIG. 75 a partial schematic section view of a portion of a further embodiment of a device for applying and/or packaging a product;

FIG. 76 a partial schematic section view of a portion of another embodiment of a device for applying and/or packaging a product;

FIG. 77 a partial schematic section view of a portion of a further embodiment of a device for applying and/or packaging a product;

FIG. 78 is a schematic perspective view of a portion of another embodiment of a device for applying and/or packaging a product;

FIG. 79 is a schematic perspective view of a portion of a further embodiment of a device for applying and/or packaging a product;

FIG. 80 is a schematic perspective hidden view of a portion of another embodiment of a device for applying and/or packaging a product;

FIG. 81 is a schematic perspective view of a portion of a further embodiment of a device for applying and/or packaging a product;

FIG. 82 is a schematic perspective hidden view of a portion of another embodiment of a device for applying and/or packaging a product;

FIG. 83 is a schematic perspective hidden view of a portion of a further embodiment of a device for applying and/or packaging a product;

FIG. 84 is a schematic perspective view of a portion of another embodiment of a device for applying and/or packaging a product;

FIG. 85 is a schematic perspective view of a portion of a further embodiment of a device for applying and/or packaging a product;

FIG. 86 is a schematic section view of a portion of another embodiment of a device for applying and/or packaging a product;

FIG. 87 is a schematic perspective view of a portion of a further embodiment of a device for applying and/or packaging a product;

FIG. 88 is a schematic perspective section view of a portion of another embodiment of a device for applying and/or packaging a product;

FIG. 89 is a schematic section view of a portion of a further embodiment of a device for applying and/or packaging a product;

FIG. 90 is a schematic perspective section view of a portion of another embodiment of a device for applying and/or packaging a product;

FIG. 91 is a schematic perspective view of a portion of a further embodiment of a device for applying and/or packaging a product;

FIG. 92 is a schematic section view of a portion of another embodiment of a device for applying and/or packaging a product;

FIG. 93 is a schematic partial section view of a further embodiment of a device for applying and/or packaging a product;

FIG. 94 is a schematic partial section view of another embodiment of a device for applying and/or packaging a product;

FIG. 95 is a schematic partial section view of a further embodiment of a device for applying and/or packaging a product;

FIG. 96 is a schematic partial section view of another embodiment of a device for applying and/or packaging a product;

FIG. 97 is a schematic partial section view of a further embodiment of a device for applying and/or packaging a product; and FIG. 98 is a schematic partial section view of another embodiment of a device for applying and/or packaging a product.

Reference will now be made in detail to some possible embodiments of the invention, examples of which are illustrated in the accompanying drawings. Wherever possible, the same reference numbers are used in the drawings and the description to refer to the same or like parts.

In some exemplary embodiments of a device for applying a product, particles containing a substance suitable for exerting an action on a product (e.g., a fluid product) such as a cosmetic product and/or care product (e.g., a skin care product for application to the skin, a product for application to the mucous membranes, and/or a product for application to hair and/or nails), may be retained within an element configured to be immersed in the product.

Figure 1:
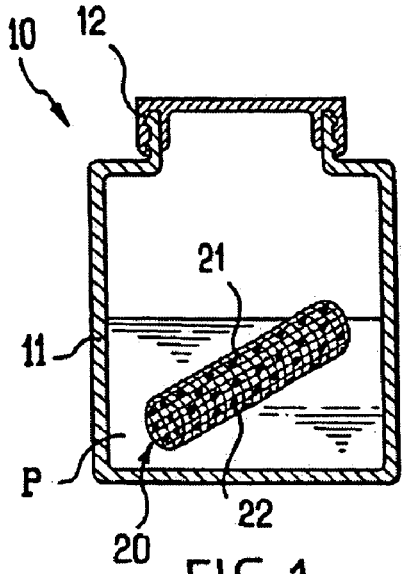

FIG. 1 depicts an exemplary embodiment of a device 10 that may include a receptacle 11 containing a product P (e.g., a fluid), for example, a liquid cosmetic product, and an element 20 that may be immersed in the product P. The element 20 may contain particles 22. For example, the receptacle 11 may be closed in a substantially hermetic manner by using a lid 12, which, for example, may be configured to be coupled to the receptacle 11 via, for example, screw-fastening and/or snap-fastening.

It is contemplated that the receptacle 11 and the element 20 may have many different possible configurations. For example, FIG. 1 depicts an element 20 having a wall 21 that may be permeable to the product P and may have openings and/or pores that may, for example, be small enough to substantially prevent the particles 22 contained inside the element 20 from escaping. For example, the wall 21 may include or be constituted by at least one sheet of material that is permeable to the product P, for example, an open-celled foam, a woven cloth, a non-woven cloth, a perforated film, a thermoformed net, an injected thermoplastic material, and/or a plurality of components assembled to one another (e.g., a porous structure and reinforcement).

The element 20 may be present in the receptacle 11 originally (e.g., when sold to the consumer), or the element 20 may be inserted, for example, into the receptacle 11 prior to first use (e.g., by the consumer). The element 20 may be selected, for example, from among a plurality of elements 20 containing particles 22 having different characteristics. For example, the particles 22 may be configured to, for example, release different substances into the product P. Thus, the user may select the element 20 as a function of the properties the user desires to impart to the product P, for example, in order to enrich the product P with certain active ingredients (e.g. minerals and/or organic materials). The particles 22 may also possess electrical and/or magnetic properties configured to act on the product P. In some embodiments, the element 20 may be removed from the receptacle 11 prior to applying the product P.

In some exemplary embodiments, it may be possible for the element 20 (whose shape is not limited to the shape shown in FIG. 1) to be used as an applicator for the product P. For example, element 20 may be reinserted into the receptacle 11 after a number applications (e.g., each application) and be discarded after use. For example, the the element 20 may be configured for single use only.

The element 20 may be configured to enable the user to insert user-selected particles 22 therein. The particles 22 may be taken, for example, from a set of receptacles available to the user. Thus, by selecting the particles 22 to be inserted into the element 20, the user may be able to modify the effects that may be exerted by the particles 22 on the product P. For example, the element 20 may have an opening for receiving particles, which may be configured to be closed via, for example, a removable shutter.

Figure 2:
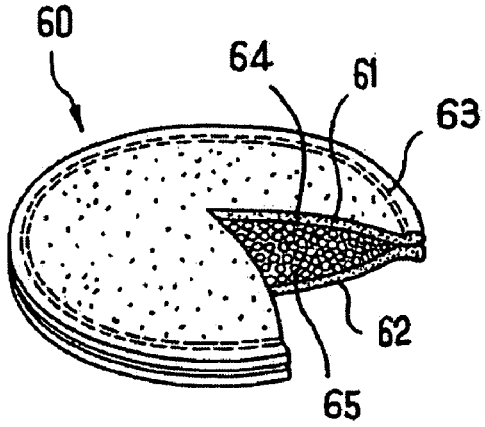
FIG. 2 is a perspective partial cut-away view of another embodiment of a device for applying and/or packaging product.

FIG. 2 depicts an exemplary embodiment of an element 60 that may be in the form of, for example, a sachet including two sheets 61 and 62 that may be permeable to the product P and that may be sealed together around their periphery 63, for example, so as to define an inner space 64 containing a plurality of particles 65 that may be held captive inside the element 60. The particles 65 may include a substance suitable for diffusing on contact with the product P, which may be poured onto the element 60. Alternatively, the element 60 may be substantially immersed in the product P.

In some exemplary embodiments, the particles 65 may be substantially (e.g., totally) inert relative to the product P (e.g., the particles 65 may be substantially incapable of releasing a given substance when in contact therewith). For example, the particles 65 may serve solely to increase the capacity of the element 60 for taking in the product P, for example, by absorbing the product P via capillarity through the sheets 61 and/or 62. The sheets 61 and 62 may be flexible (e.g., they may be include an open-celled foam, a woven and/or non-woven cloth, a perforated film, a net of thermoplastic material, and/or a thermoplastic laminate). The element 60 may be used for applying the product P, for example, to the skin, and the element 60 may include flocking on its surface, for example.

Figure 3:
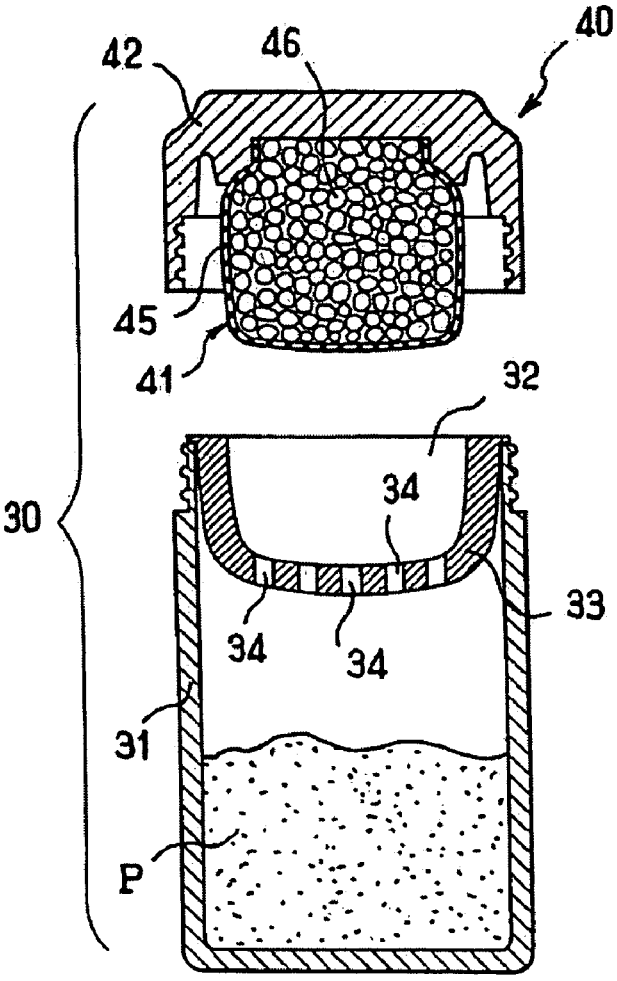
FIG. 3 is a schematic partial section view of a further embodiment of a device for applying and/or packaging a product.

In some embodiments, the element 20 (or 60) may be replaced by an element that may be secured to a handle member. For example, FIG. 3 depicts an exemplary embodiment of a device 30 that may include a receptacle 31 for containing a product P (e.g., a liquid cosmetic product), and an applicator 40 having an applicator element 41 supported by a handle member 42 that may also serve as a closure member for enabling the receptacle 31 to be closed, for example, in substantially a hermetic manner. The receptacle 31 may include a housing 32 for receiving at least part of the applicator element 41, for example, when the receptacle 31 is closed. In the exemplary embodiment depicted in FIG. 3, the housing 32 may be substantially defined by a part 33 having passages 34 for enabling flow communication between the inside of the housing 32 and the supply of product P contained in the receptacle 31.

Figure 3A:
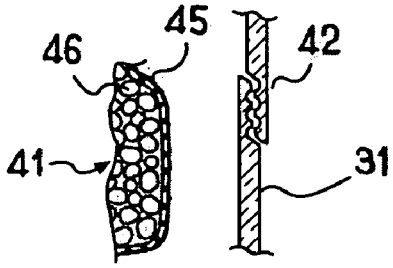
FIG. 3A is a schematic partial section view of an embodiment of a device for applying and/or packaging a product shown in FIG. 3.

The applicator element 41 may include a wall 45 that is permeable to the product P. The wall 45 may be either rigid or flexible, and may be include, for example, a grid (e.g., a thermoformed net, a woven and/or non-woven cloth, a sponge, a sintered piece, and/or a perforated film), although other structures are contemplated. The wall 45 may at least partially define an inner space (e.g., a volume defined by the plurality of particles may be greater than a volume of the wall 45) in which particles 46 may be retained (e.g., at least some of the plurality of particles may contact each other), and the particles 46 may be large enough to substantially prevent them from passing through the wall 45, for example, when the wall 45 has openings (e.g., at least one passage in the wall 45 may be configured to pass the product therethrough). According to some embodiments, for example, as schematically depicted in FIG. 3A, a device may include transparent material (e.g., the receptacle 31 and/or the handle member 42 may be formed from a transparent material) configured to enable a user to see the applicator element 41 when the device is closed.

The particles 46 may be suitable for releasing a substance when contacting the product P. In some exemplary embodiments, when the particles 46 are suitable for releasing a substance on contact with the product P, the substance may diffuse into the product P so as to modify its properties, for example, so as to improve any preservative properties that may be present. Alternatively, for example, when the particles 46 are substantially inert relative to the product P and do not release any substance into it, the particles 46 may serve merely to absorb the product P, for example, via capillarity through the wall 45 (e.g., for the purpose of enabling the applicator 40 to take up a larger quantity of the product P). The particles 46 may also serve to exert a magnetic and/or an electric field on the product P and/or on the surface onto which the product P is to be applied.

Some examples of particles 46 that may be used include beads (e.g., ceramic beads) sold by the supplier EPR France under the registered trademarks ZIRMIL® and ZIRBLAST®, for example, ZIRBLAST® ER120®, ER 1205®, ZIRSHOT®, and/or ERMIL®. The beads used may have a granular microstructure and/or surface roughness that may be relatively large, and they may optionally be coated. For example, the beads may be formed from a mixture of zirconium dioxide and silica.

According to some exemplary embodiments, the part 33 may itself include a substance that may be suitable for acting on the product P, for example, as the product P passes through the part 33 via the passages 34. The part 33 may be formed by injecting a thermoplastic material, by rotational molding, or by sintering, for example, in order to form a ceramic.

According to some exemplary embodiments, the applicator may be configured so that the user, for example, prior to first use, may place the particles into the applicator. Alternatively, or in addition, the applicator may be configured so that the user can replace the particles, for example, if a substance contained in or constituting the particles is used up and/or if the user desires to change the type of substance with which the product P is to come into contact (e.g., in order to change the effect exerted by the particles on the product P and/or on the surface onto which the product P is to be applied).

Figure 4:
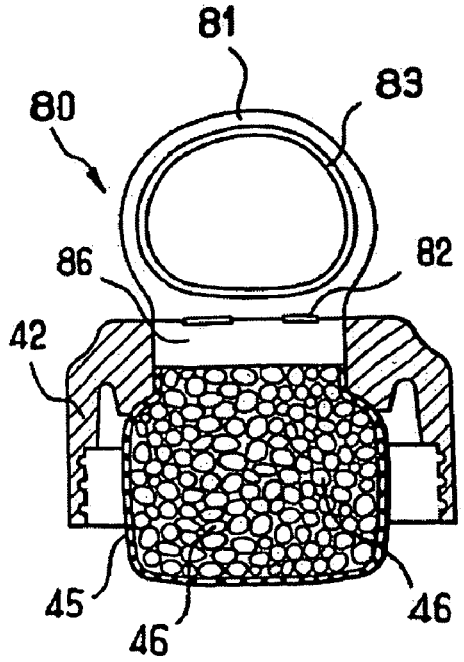
FIG. 4 is a schematic partial section view of another embodiment of a device for applying and/or packaging a product.

For example, FIG. 4 depicts an applicator 80 substantially corresponding to the applicator 40 in the exemplary embodiment depicted in FIG. 3. The applicator 80 differs from the applicator 40 at least by virtue of the fact that the handle member 42 may include an opening 86, for example, for allowing access to the interior space containing the particles 46, as partially defined by the wall 45. A closure member 81 may be included to enable the opening 86 to be closed. The closure member 81 may include, for example, a lid (e.g., a hinged lid connected via a film hinge 82 to the body of the handle member 42). The lid may have a sealing lip 83 suitable for pressing in a substantially leak-tight manner against a wall of the handle member 42 defining the opening 46. For example, the particles 46 may be inserted via the opening 86 prior to closing the lid.

Figure 5:
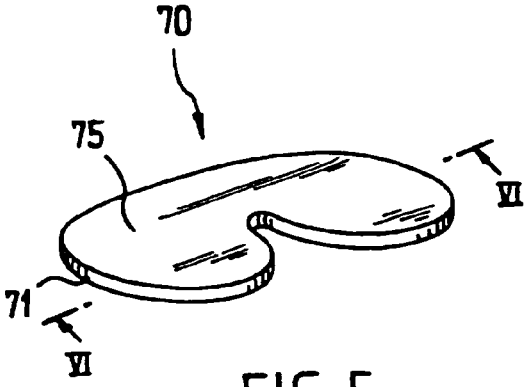
FIG. 5 is a perspective view of a further embodiment of a device for applying and/or packaging a product.
Figure 6:
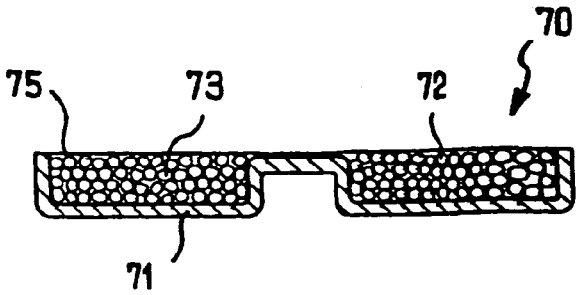
FIG. 6 is a section view along line VI—VI of FIG. 5.

In exemplary embodiments configured to treat the body or the face, the element containing particles may be shaped, for example, depending on the region of the body or the face to be treated. For example, FIGS. 5 and 6 depict an exemplary embodiment of a device 70 having the general shape of a mask, as depicted in FIG. 6, for example, that may include a wall 71 (e.g., a thermoformed wall) that may be substantially impermeable to a product P. The wall 71 may be substantially mask-shaped, for example, and may define a housing 72 containing a plurality of particles 73. The housing 72 may be closed on a face remote from the wall 71 by a wall 75 that may be permeable to the product P. The wall 75 may include, for example, a non-woven sheet having its periphery fixed to the wall 71. The housing 72 may be already filled with the product P when the user makes first use of the device 70, and/or, according to some exemplary embodiments, the user may insert the product P into the housing 72 (e.g., by pouring the product P into the housing 72 through the wall 75, and/or by substantially immersing the device 70 in a receptacle containing the product P).

In some exemplary embodiments, such as those depicted in FIGS. 1 through 6, the particles may be free in the space which contains them (e.g., if a wall holding the particles in the space is torn or otherwise opened, the particles may escape).

According to some exemplary embodiments, the particles may be free in the receptacle containing the product P, and may be retained therein by a member such as, for example, a strainer and/or a filter that may be configured to allow only the product P to pass therethrough.

Figure 7:
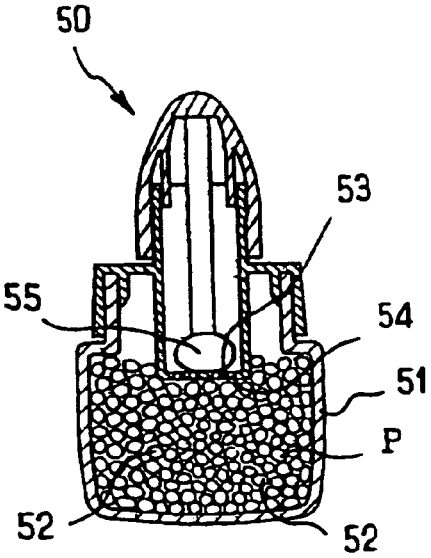
FIG. 7 is a schematic partial section view of a further embodiment of a device for applying and/or packaging a product.

For example, FIG. 7 depicts an exemplary embodiment of a device 50 that may contain a product P along with particles 52 (e.g., beads in receptacle 51). A member 53, for example, shaped like the finger of a glove and having an end wall with openings 54 may enable the product P to pass to an applicator 55, but may substantially prevent the particles 52 from leaving the receptacle 51. In all of the previously mentioned exemplary embodiments, it is contemplated that the particles may be of various sizes and/or types.

According to some exemplary embodiments, it is possible to exert an action, for example, a magnetic action, on the product P solely while the product P is being stored.

Figure 8:
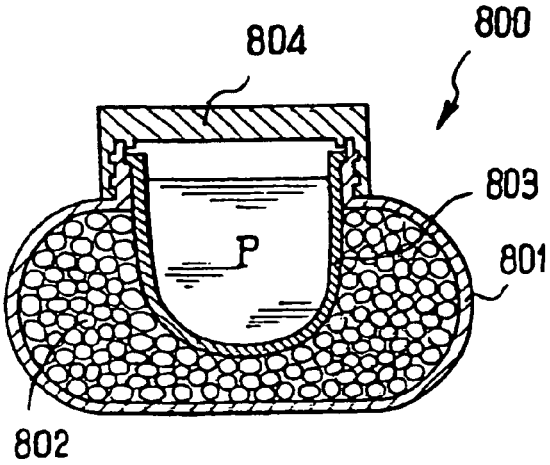
FIG. 8 is a schematic partial section view of another embodiment of a device for applying and/or packaging a product.

For example, FIG. 8 depicts an exemplary embodiment of a device 800 enabling a magnetic action to be exerted on the product P. The product P may be contained in a cup 803 inserted in a receptacle 801. The cup 803 and/or receptacle 801 may be closed, for example, by a closure structure 804. The inside volume between the cup 803 and the wall of the receptacle 801 may contain particles 802 configured to exert a magnetic action on the product P.

Some exemplary embodiments have particles that may be capable of being released and that may be configured to exert an action on the product P and/or to release a substance into the product P. Some examples of such embodiments are described with reference to FIGS. 25 through 30, FIG. 39, and FIGS. 41 through 44.

At least one substance suitable for contacting with the product P and/or for exerting a magnetic field and/or an electric field thereon may also be contained in, for example, a sintered piece (e.g., a ceramic element and/or any other porous element, for example, a foam).

Figure 9:
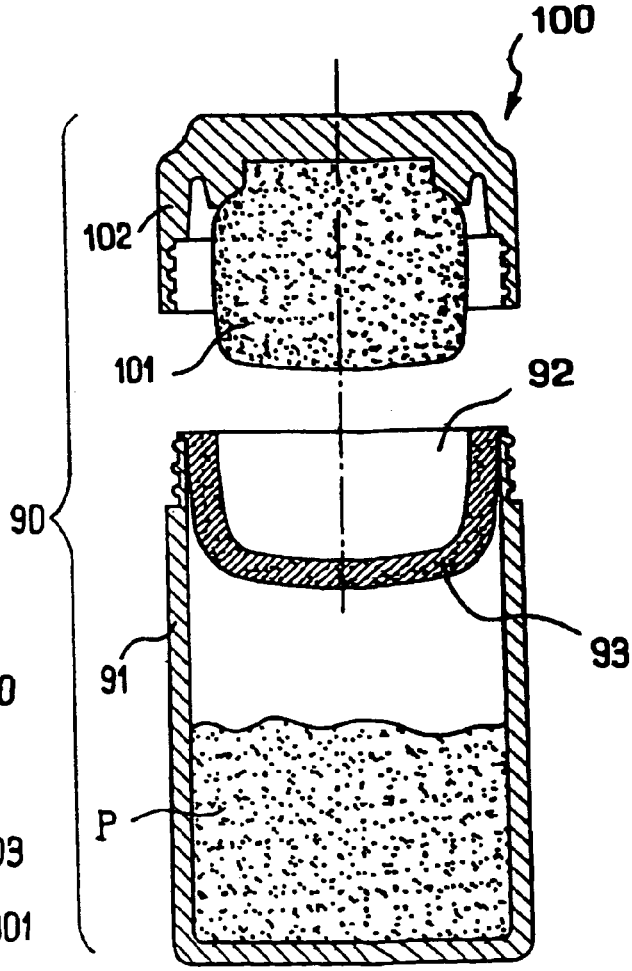
FIG. 9 is a schematic partial section view of a further embodiment of a device for applying and/or packaging a product.

FIG. 9 depicts an exemplary embodiment of a device 90 that may include a receptacle 91 containing a product P and an applicator 100 that may include an applicator member 101 supported by, for example, a handle member 102, which may also be configured to close the receptacle 91. The receptacle 91 may include a housing 92 for receiving the applicator member 101. The housing 92 may be at least partially defined by an element 93 formed of, for example, a sintered piece. The element 93 may be permeable to the product P so as to enable the product P to reach the applicator member 101. The sintered piece may be, for example, a sintered ceramic, a metal, one or more plastic materials (e.g., sintered together particles of, for example, beads of plastic material(s), for example, an elastomeric material). In some exemplary embodiments, a substance may be released into the product P by a material constituting the sintered piece, and the material may, in some instances, impart mechanical strength to the sintered piece and/or the sintered piece may include the material in its basic formulation. The substance may, for example, include a substantial portion (e.g., all) of the powder used for making the sintered piece. Alternatively, the sintered piece may include, for example, a combination of the substance along with other components in the powder.

The substance may be incorporated into the sintered piece and/or other porous elements such as, for example, a foam, after manufacture thereof (e.g., by immersing the sintered piece in a liquid containing the substance in a substantially dissolved state and/or in suspension). The substance may subsequently cause the liquid (e.g., that impregnated the sintered piece and/or other porous element) to substantially evaporate. The substance may then crystallize inside the sintered piece after the liquid that was used for inserting it therein has evaporated, for example.

The substance which is to be incorporated in the sintered piece and/or other porous element may also be in the form of a grains that may be dispersed in a liquid. Under such circumstances, the size of the grains and their concentration may be selected as a function of the size of the pores in the sintered piece and/or the porous element so as to enable the grains to penetrate therein while avoiding substantially clogging the pores.

The substance present in the sintered piece and/or other porous element may be intended to diffuse (e.g. in trace form) into the product P so as to confer predetermined properties therein, for example, to improve its preservative properties and/or to give rise to enzymatic and/or catalytic reactions therein. Alternatively, or in addition, the substance present in the sintered piece and/or other porous element may serve to purify the product, for example, by adsorbing certain compounds that may be present in the product and/or that may be present in the applicator element. The substance present in the sintered piece and/or other porous element may be intended to exert a magnetic field and/or an electric field on the product P.

In some exemplary embodiments, the element 93 may not only include pores that may render the element 93 permeable to the product P, but the element 93 may also include passages passing therethrough that may enable the product to reach the housing 92 more easily, for example, at least similar to the passages 34 in the exemplary embodiment of the device 30, as shown in FIG. 3. The element 93 may also have pores that may be too small to be intrinsically permeable to the product P, and therefore there could also be openings formed similar to, for example, the passages 34 in the device 30 so as to allow the product P to pass therethrough. In some exemplary embodiments, these openings may form baffles.

The applicator element 101 may include, for example, a foam, a felt, and/or a sintered piece, which may optionally have flocking on its surface. The applicator element 101 may be arranged to cooperate with the receptacle containing the product P so that withdrawing the applicator element 101 may have pumping effect on the product P in the housing that receives the applicator element 101.

In some exemplary embodiments, the applicator 100 may be replaced by one of the previously mentioned applicators, for example, applicator 40 shown in FIG. 3, and applicator 80 shown in FIG. 4.

Figure 10:
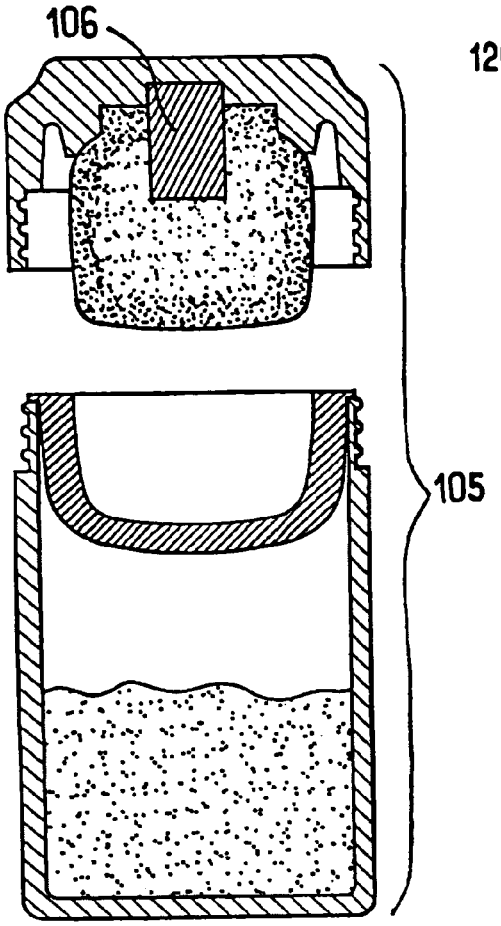
FIG. 10 is a schematic partial section view of another embodiment of a device for applying and/or packaging a product.

The exemplary embodiment of a device 105 shown in FIG. 10 depicts an applicator at least similar to the applicator 100 shown in FIG. 9, which includes a magnet 106 that may serve to exert a magnetic action (e.g., during application), for example, to encourage microcirculation of the blood. The element 93 of FIG. 9 may be replaced, for example, by a part including an element formed from a sintered piece and/or any other porous element along with a support for the element, for example, formed from material that is not sintered.

Figure 11:
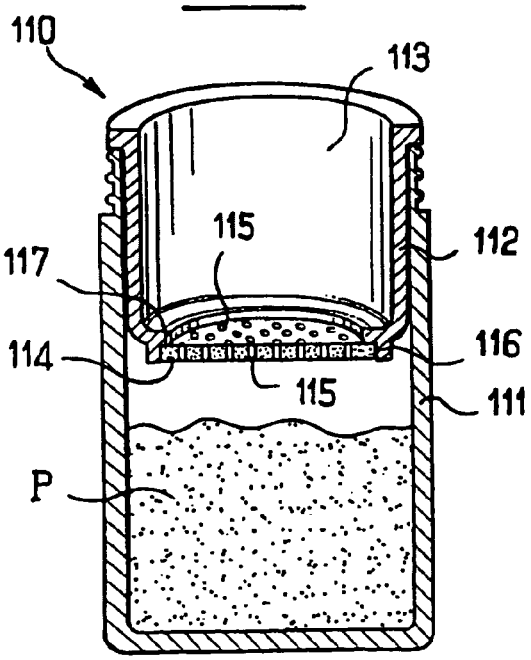
FIG. 11 is a schematic partial section view of a further embodiment of a device for applying and/or packaging a product.

For example, FIG. 11 shows an exemplary embodiment of a device 110 that may include a receptacle 111 that receives a part 112 defining a housing 113 for an applicator element (not shown). The end wall of the housing 113 may include an element 114, for example, formed as a sintered piece. The element 114 may be in the form of, for example, a pellet having one or more passages 115 that may enable the product P contained in the receptacle 111 to reach the housing 113. The element 114 may be secured by, for example, an annular rib 116, and the element 114 may bear against a shoulder 117.

In some exemplary embodiments, the element 114 may be formed of a material that is not sintered, for example, a plastic material that may have a solid form, a perforated form, and/or a cellular form, and, for example, may contain a number of particles that may be suitable for releasing a given substance when the product P passes through the passage(s) 115 and/or for exerting a magnetic field on the product P.

The passage(s) 115 through which the product P may pass in order to reach the applicator element may have a shape that serves to increase the contact area between the product P and the element 114 through which the product P passes.

Figure 12:
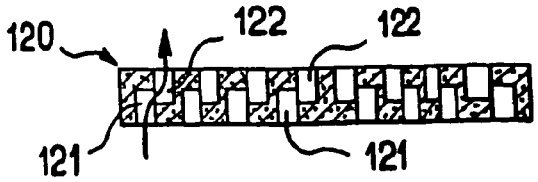
FIG. 12 is a schematic section view of a portion of another embodiment of a device for applying and/or packaging a product.

For example, FIG. 12 shows an exemplary embodiment of an element 120 including a sintered piece, for example, having blind holes 121 and 122 that open out into opposite faces thereof and that may lie on axes that are parallel but offset so as to create baffles that may constrain the product P such that it follows a longer path when it passes through the element 120.

Figure 13:
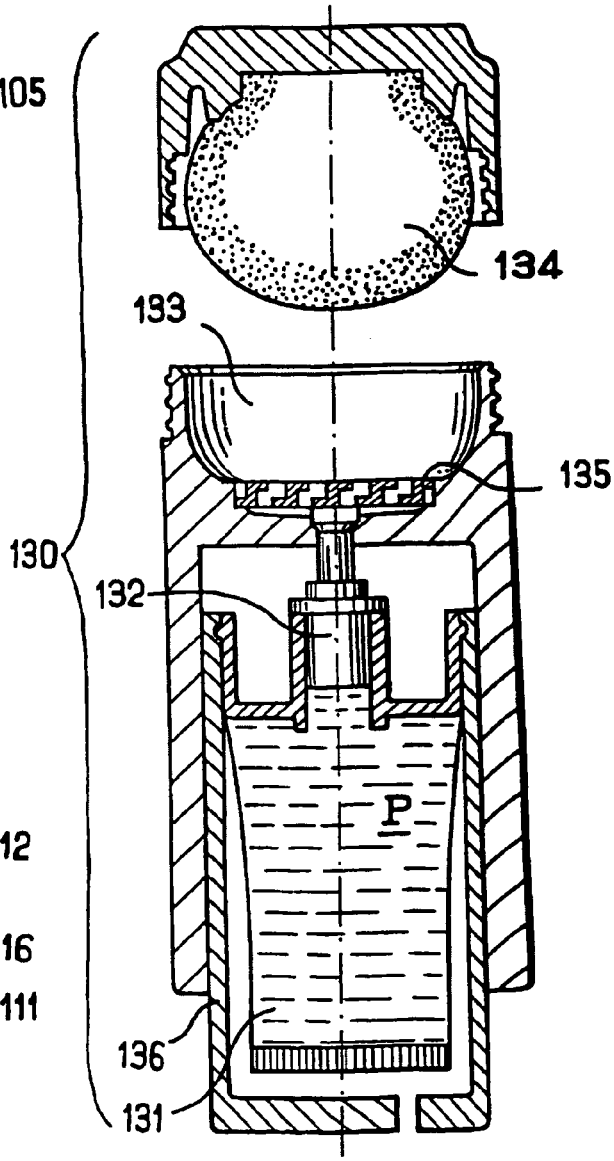
FIG. 13 is a schematic partial section view of a further embodiment of a device for applying and/or packaging a product.

In some embodiments, the product P may be ackaged in numerous ways other than those described above. For example, FIG. 13 shows an exemplary embodiment of a device 130 in which the product P may be dispensed via, for example, a pump 132. The product P may be drawn from a flexible bag 131 and may be delivered into a housing 133 in which an applicator element 134 may be placed, for example, in order to become filled with the product P. In order to actuate the pump, the housing 133 is pressed down (e.g., the housing being movable relative to the bag 131 and relative to the receptacle 136 containing the bag 131). The end wall of the housing 133 may contain an element 135 analogous to the element 120 described above with reference to FIG. 12, the element 135 being placed so that the product P delivered by the pump 132 passes through the element 135. The element 135 may serve to release a given substance on contacting the product P as the product P passes through it and/or may serve to expose the product P to a magnetic field and/or an electric field. The element 135 may have passages of a shape other than that shown, for example, passages that are rectilinear and that may be at least similar to those of element 114 shown in FIG. 11. Alternatively, the element 114 need not have any specific passage configuration (e.g., the product P may pass through the element 135 via pores that communicate with one another in substantially all directions).

The applicator element 134 may be of any kind, for example, such as the applicators 40 or 80, as described above. The applicator element 134 may include, for example, a porous material such as a foam, a felt, and/or a sintered piece. The material may contain (e.g., may be filled with) various particles (e.g., particles suitable for releasing a predetermined substance on contacting the product P and/or for exerting a magnetic field and/or an electric field). In some embodiments (not shown), the applicator element 134 may have portions in relief, for example, setbacks, and/or it may have flocking on its surface.

Figure 14:
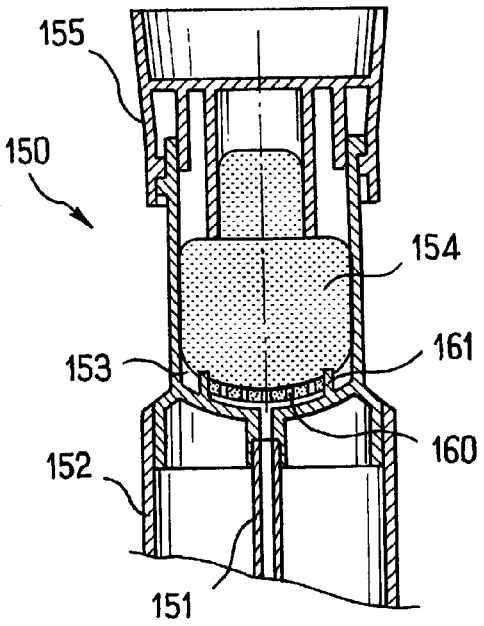
FIG. 14 is a schematic partial section view of another embodiment of a device for applying and/or packaging a product.

The product P may enter a housing suitable for receiving an applicator element, for example, via a dip tube such as the exemplary device 150 shown in part in FIG. 14. The device 150 may include a dip tube 151 suitable for enabling a product P contained in a receptacle 152 to reach a housing 153 in which an applicator element 154 may be received. The applicator element 154 may be secured to a handle member 155 that may also include a member for closing the housing 153. For example, the closure member 155 may be arranged to close the housing 153 in a substantially hermetic manner while the applicator element 154 is in place therein.

The product P may enter into the housing 153 via the dip tube 151 (e.g., by compressing the wall of the receptacle 152). In some exemplary embodiments, because the housing 153 may be closed in a substantially hermetic manner while the applicator element 154 is in place therein, a reduction in the inside volume of the receptacle 152 may cause the product P to rise into the housing via the dip tube 151 and may increase the pressure inside the housing 153. This increase in pressure may tend to oppose the rise of the product P along the dip tube 151, thus rendering it easier for the user to measure out the quantity of product P that is delivered to the housing 153.

An element 160 that may be configured, for example, to release a given substance on contact with the product P delivered by the dip tube 151 into the housing 153 and/or for exerting a magnetic field and/or an electric field on the product P, may be placed in the bottom of the housing 153 and may be fixed thereto by means of, for example, an annular rib 161.

The applicator element 154 according to some exemplary embodiments may include a sintered piece retaining a substance that may be configured to exert a physical and/or chemical action on the product P. An element configured to exert an action on the product P, for example, for subjecting it to a magnetic and/or an electric field and/or for releasing a given substance into the product P on contacting with the element, for example, on passing through the element, may be integrated into a closure capsule having a dispenser and/or pushbutton end-piece, as described with reference to FIGS. 15 through 22.

Figure 15:
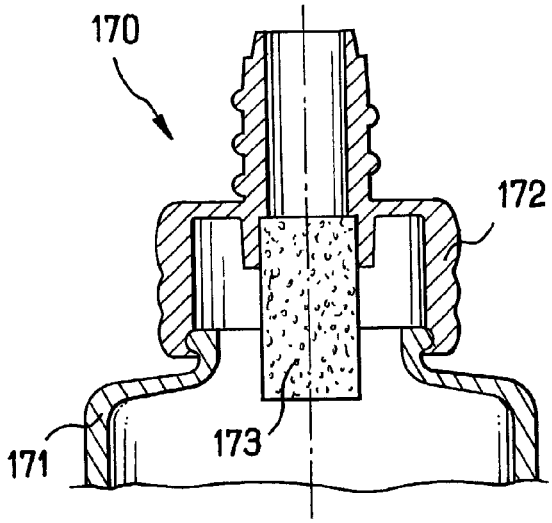
FIG. 15 is a schematic partial section view of a further embodiment of a device for applying and/or packaging a product.

FIG. 15 shows an exemplary embodiment of a device 170 that may include a receptacle 171 containing, for example, a cosmetic product, and that may have fixed thereon a dispenser end-piece 172 supporting an element 173 disposed in such a manner so as to have the product P contained in the receptacle 171 pass therethrough. The element 173 may include, for example, a foam and/or a sintered piece that may retain a predetermined substance in the solid state.

Figure 16:
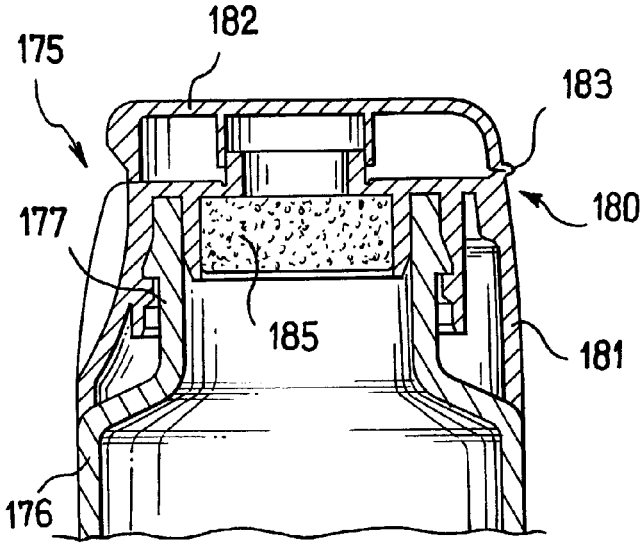
FIG. 16 is a schematic partial section view of another embodiment of a device for applying and/or packaging a product.

FIG. 16 shows a portion of an exemplary embodiment of a device 175 including a receptacle 176 whose neck 177 may be fitted with a closure capsule 180 having a base portion 181 that may be fixed onto the neck 177 (e.g., via snap-fastening), and a lid 182 that may be hinged to the base portion 181, for example, via a film hinge 183. The base portion 181 may house an element 185 that may be at least partially permeable to the product P contained in the receptacle 176, and that may be disposed as a filter so that the product P passes therethrough, for example, when being dispensed. The element 185 may include, for example, a sintered piece and/or a foam containing a predetermined substance (e.g. a substance that may diffuse into the product P).

Figure 17:
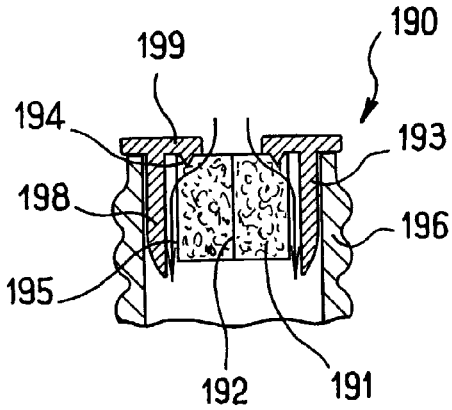
FIG. 17 is a schematic partial section view of a further embodiment of a device for applying and/or packaging a product.

FIG. 17 shows an exemplary embodiment of a device 190 that may include a flow reducer 191 for fixing to a receptacle 196 containing a product P (e.g., a liquid), for example, a shower gel, a shampoo, a body lotion, and/or an oil, although other types of products are contemplated. The receptacle may have variable interior volume and may have walls that can be squeezed by the user in order to dispense the product P. The neck of the receptacle may receive an insert 193 including a tubular skirt 198 engaged via, for example, a force fit in the neck and may be connected to a plate 199, which may include an outlet orifice (e.g., a central outlet orifice). The plate 199 may have a periphery that rests against the top end edge of the neck. The tubular skirt 198 may bear in a substantially leak-tight manner against the inside surface of the neck. The flow reducer 191 may be formed from a foam and may be substantially circularly cylindrical, for example, as shown in FIG. 17, and its top face may be coupled to the plate 199. The flow reducer 191 may include a single block of foam (e.g., foam formed from polyurethane, polyester, polyether, PVC, nitrite butadiene rubber (NBR), although other materials are contemplated). The foam may contain particles that may be retained therein (e.g., particles including a substance suitable for contacting with the product P as the product P passes through the flow reducer 191). In some exemplary embodiments, a passage 192 passes through the flow reducer 191 and, at rest, the passage may be substantially closed (at least at one point along its length), and may be capable of opening under pressure from the product P. In order to facilitate air intake, for example, a gap 195 may be included between the side surface of the flow reducer 191 and the tubular skirt 198. The flow reducer 191 may be coupled, for example, via its top face to the underside of the plate 199. The insert 193 may have an annular rib 194 extending beneath the plate 199, which may be heated, for example, if and when the flow reducer 191 is heat-sealed to the insert 193.

Figure 18:
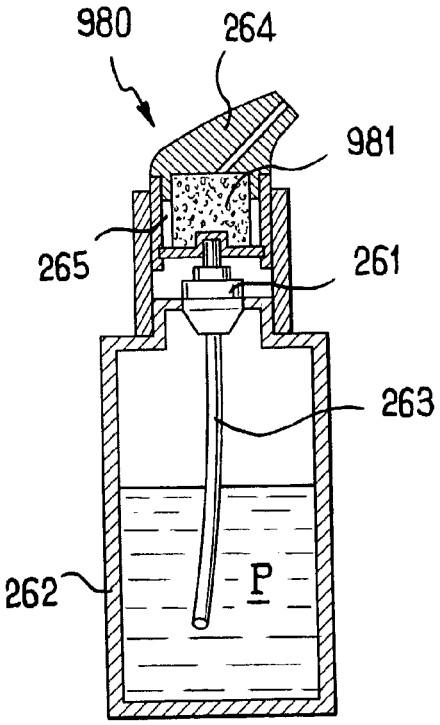
FIG. 18 is a schematic partial section view of another embodiment of a device for applying and/or packaging a product.

The substance may be contained in a foam through which the product P passes when it is dispensed. For example, FIG. 18 shows an exemplary embodiment of a device 980 that may have a pump 261 for taking product P from a receptacle 262. The pump 261 may be connected to a dip tube 263. The pump 261 may be actuated via a pushbutton 264 that may present a housing 265 containing, for example, a foam 981 containing a plurality of particles configured to exert an action on the product P, for example, by allowing a given substance to diffuse into the product P and/or to exert a magnetic field and/or an electric field on the product P. In some embodiments, the pushbutton 264 may be withdrawn from the receptacle 262 so as to allow the user to select one pushbutton 264 from a set of pushbuttons, which may each contain a substance of a different type and/or characteristic.

Figure 19:
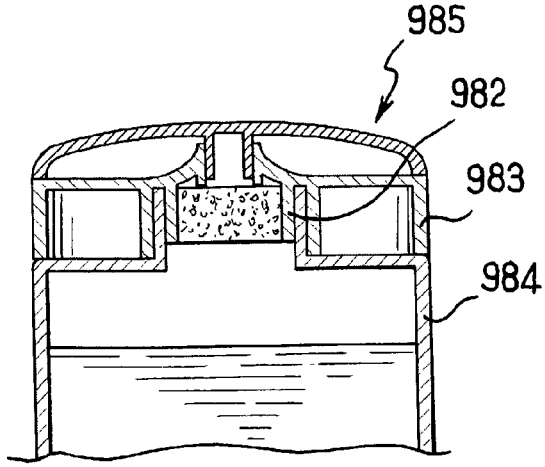
FIG. 19 is a schematic partial section view of a further embodiment of a device for applying and/or packaging a product.

The element for exerting an action on the product P may be coupled to the inside neck 982 of a closure capsule 983 that may be coupled to a receptacle 984 of a device 985, as shown in the exemplary embodiment depicted in FIG. 19.

Figure 20:
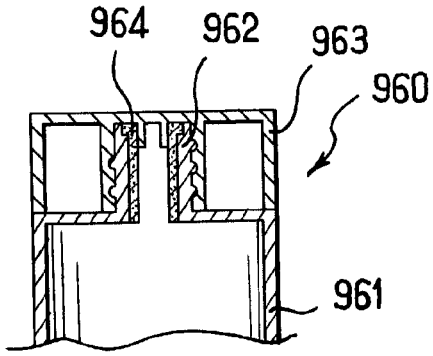
FIG. 20 is a schematic partial section view of another embodiment of a device for applying and/or packaging a product.

FIG. 20 depicts an exemplary embodiment of a device 960 in which a substance to be diffused into the product P and/or to exert a magnetic field and/or an electric field thereon may be included in a tube forming an orifice for dispensing the product P. The device 960 may include a receptacle 961 having a neck 962 with an outside thread thereon for receiving a closure cap 963. A tube 964 may contain the substance and may be fixed to the inside of the neck 962 and exert an action on the product P while it is being dispensed.

Figure 21:
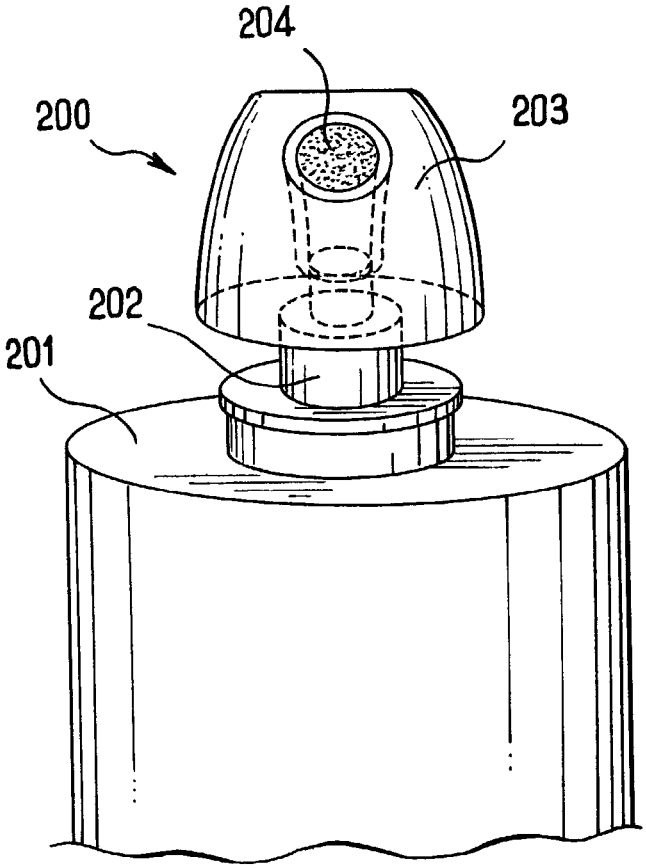
FIG. 21 is a partial schematic perspective view of a further embodiment of a device for applying and/or packaging a product.

FIG. 21 depicts an exemplary embodiment of a device 200 that may include a receptacle 201 having a pump 202 and a pushbutton 203 for enabling the pump 202 to be actuated. The pushbutton 203 may have an element 204 configured to allow the product P to pass therethrough while a dose of product P is being dispensed. The element 204 my include, for example, a foam and/or a sintered piece containing a predetermined substance.

Figure 22:
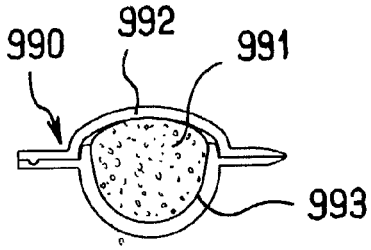
FIG. 22 is a schematic section view of a portion of another embodiment of a device for applying and/or packaging a product in a first condition.
Figure 23:
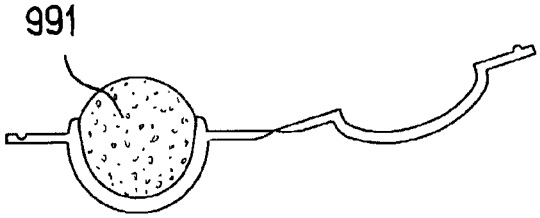
FIG. 23 is a schematic section view of the portion of a further embodiment of a device for applying and/or packaging a product shown in FIG. 22 in a second condition.

The element 204 may include, for example, a foam containing a dose of product P for use in applying the product P during a single use of the device, for example, as shown in FIGS. 22 and 23. In FIG. 22, the device 990 may be closed, for example, with the foam 991 being compressed between the lid 992 and a cavity-forming portion 993. When the lid 992 is opened, the foam 991 may return to its initial volume and may be used to apply the product P that it contains, for example, as shown in FIG. 23.

Figure 24:
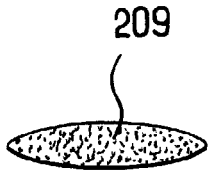
FIG. 24 is a schematic section view of a portion of another embodiment of a device for applying and/or packaging a product.

An element that is configured to exert action on the product P (e.g., by passing therethrough) may define many shapes in addition to those described above. For example, FIG. 24 depicts an element 209 formed from, for example, a sintered piece and/or a foam, which may define a lenticular shape as viewed in axial section.

Figure 25:
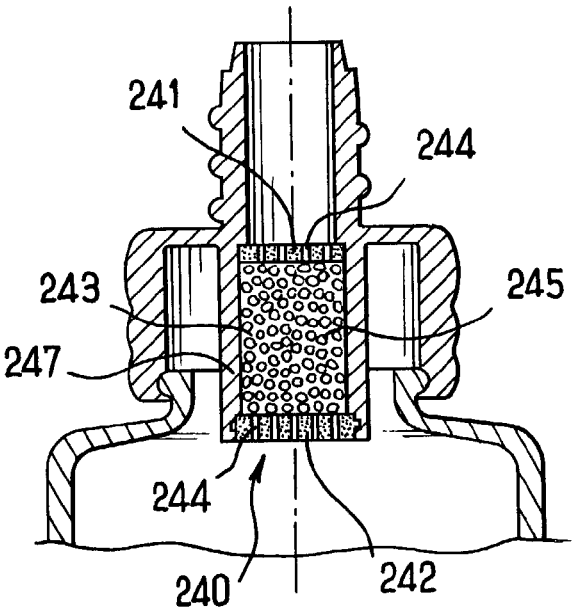
FIG. 25 is a schematic partial section view of a further embodiment of a device for applying and/or packaging a product.

FIG. 25 depicts an exemplary embodiment of a device that may include an element 240 having two spaced-apart walls 241 and 242 that may be permeable to the product P and that may partially define the top and bottom ends of a housing 243 containing a plurality of particles 245. The particles 245 may be configured, for example, to release a given substance while the product P passes through the element 240. The walls 241 and 242 may be intrinsically permeable to the product P and/or they may have one or more passages 244 for passing the product P. The walls 241 and 242 may be coupled to a chimney 247 that may be permanently secured to the receptacle. In some embodiments, the walls 241 and 242 may be fixed to a cylinder that may be configured to be removably coupled to the receptacle. The cylinder and walls 241 and 242 along with the particles contained between the walls 241 and 242 may constitute an interchangeable cartridge.

Figure 26:
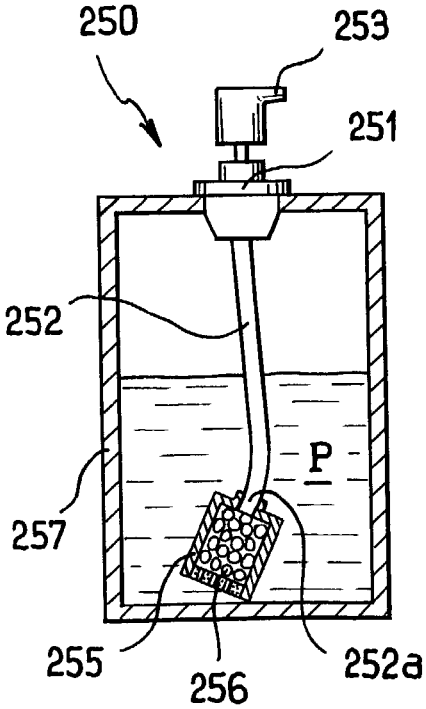
FIG. 26 is a schematic partial section view of another embodiment of a device for applying and/or packaging a product.

According to some embodiments, the particles configured to exert an action on the product P may be held captive in an element situated in the vicinity of a dispenser end-piece, for example, as shown in the exemplary embodiment depicted in FIG. 25. Alternatively, or in addition, the element may be situated, for example, in the vicinity of the end of a dip tube. For example, FIG. 26 depicts an exemplary embodiment of a device 250 configured to dispense a product P that may be contained in a receptacle 257 via a pump 251. The device 250 may include a dip tube 252 connected to the pump 251, and the pump 251 may be actuated by a pushbutton 253. The bottom end 252*a* of the tube 252 may have an element 255 containing particles 256.

Figure 27:
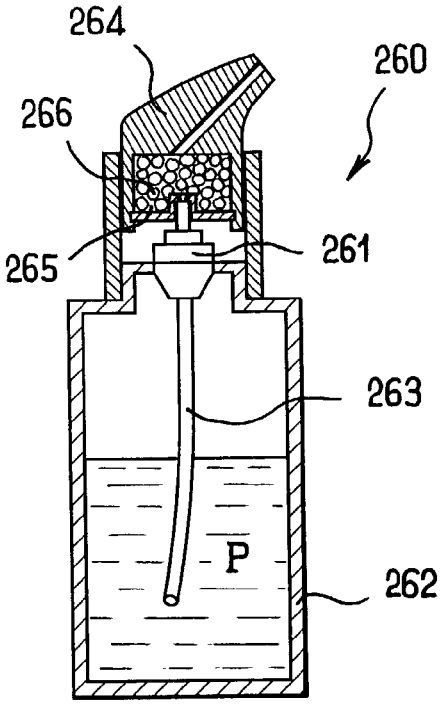
FIG. 27 is a schematic partial section view of a further embodiment of a device for applying and/or packaging a product.

FIG. 27 shows an exemplary embodiment of a device 260 that may include a plurality of particles 266 configured to exert an action on the product P, for example, by allowing a given substance to diffuse into the product P and/or by exerting a magnetic field and/or an electric field on the product P. The device 260 may include a pump 261 for taking the product P from a receptacle 262. The pump 261 may be connected to a dip tube 263. The pump 261 may be actuated by, for example, a pushbutton 264 having a housing 265 containing a plurality of particles suitable for exerting an action on the product P, for example, by allowing a given substance to diffuse into the product P and/or by exerting a magnetic field and/or an electric field on the product P. In some embodiments, the pushbutton 264 may be withdrawn from the receptacle 262 so as to enable the user to select one pushbutton 264 from a set of pushbuttons containing particles of different types.

Figure 28:
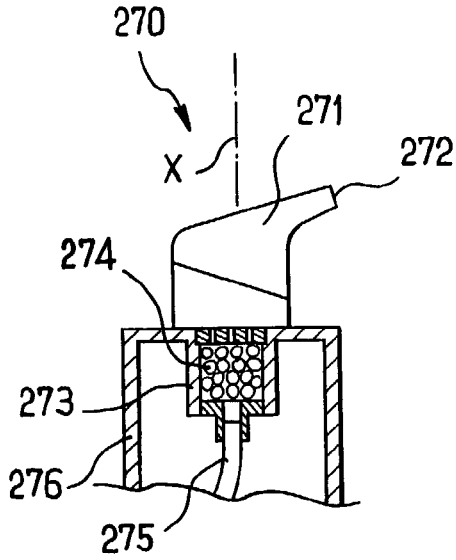
FIG. 28 is a schematic partial section view of another embodiment of a device for applying and/or packaging a product.

FIG. 28 shows an exemplary embodiment of a device 270 that may include tiltable dispenser end-piece 271 capable of turning about an axis X so as to enable an outlet orifice 272 to be pointed upward or downward. The outlet orifice 272 may be pointed downward, for example, while the product is being dispensed, and it may be pointed upward, for example, to enable any excess product P present at the end of the end-piece 271 to flow back inside the outlet orifice 272. An element 273 substantially enclosing a plurality of particles 274 may be disposed upstream from the end-piece 271. The element 273 may communicate internally with a dip tube 275 for conveying the product P, for example, when a side wall 276 of the receptacle is squeezed.

Figure 29:
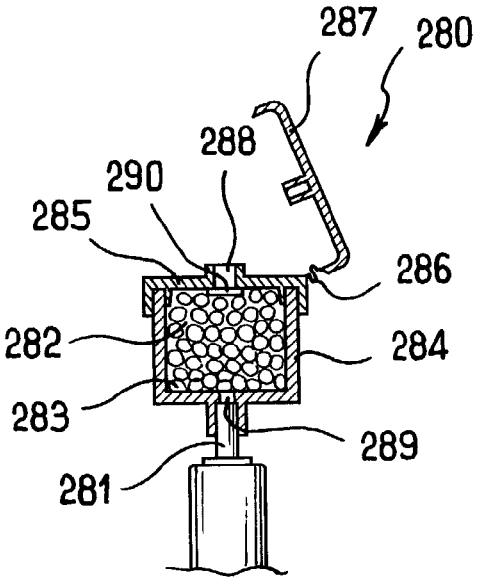
FIG. 29 is a schematic partial section view of a further embodiment of a device for applying and/or packaging a product.

FIG. 29 shows an exemplary embodiment of a device 280 that may include a cartridge suitable for being coupled to a hollow control rod 281 of a pump and/or a valve for dispensing the product P from a pressurized receptacle. The cartridge may include a housing 282 containing a plurality of particles 283. The housing 282 may be formed, for example, by assembling together a base piece 284 and a top piece 285, which may be connected by, for example, a hinge 286 (e.g., a film hinge) to a lid 287. The top piece 285 may include a dispenser end-piece 288 suitable for being closed by the lid 287. In some embodiments, grids 289 and 290 may be positioned at the inlet for product P delivered by the control rod 281 and at the dispenser end-piece 288 so as to substantially ensure that the particles 283 cannot escape.

Figure 30:
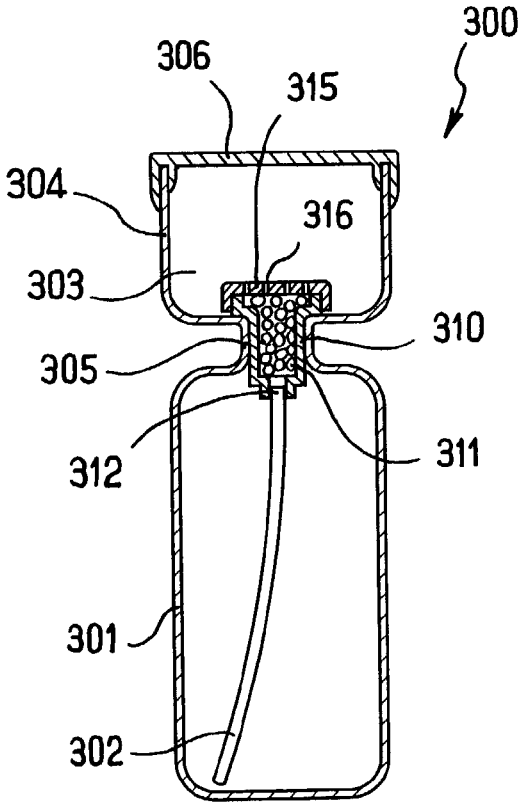
FIG. 30 is a schematic partial section view of another embodiment of a device for applying and/or packaging a product.

FIG. 30 shows an exemplary embodiment of a device 300 that may include a bottom receptacle 301 into which a dip tube 302 may extend, and a top chamber 303 at least partially defined laterally by a side wall 304 which may be formed integrally with the wall of the receptacle 301. A constriction 305 may be formed between the inside of the receptacle 301 and the chamber 303. The receptacle 301 may be formed by, for example, injection blow molding. The wall 304 may be threaded at the top to enable a cap 306 to be secured thereto. An element 310 containing a plurality of particles 311 may be located in the constriction 305. The element 310 may have a bottom end-piece 312 for securing to the dip tube 302 and a top lid 315 substantially preventing particles 311 from escaping and may include one or more passages 316 enabling the product P conveyed from the receptacle 301 to the chamber 303. The user may withdraw the product P from the chamber 303, for example, via an applicator (not shown).

A substance configured to exert an action on the product P and/or on the surface onto which the product is applied may be present within an element that is suitable for use both as a product applicator and to be passed through by the product P while the device is in use.

Figure 31:
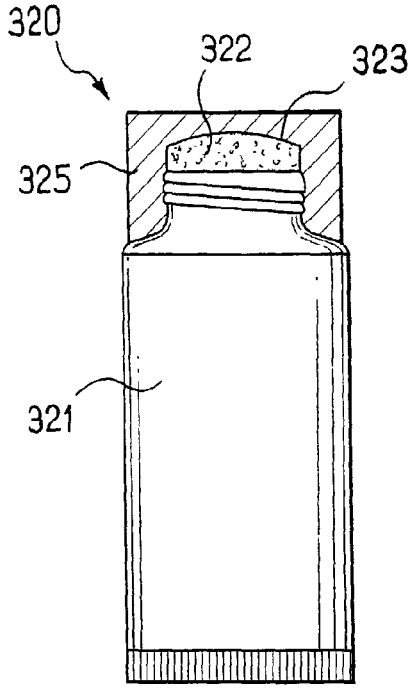
FIG. 31 is a schematic partial section view of a further embodiment of a device for applying and/or packaging a product.

For example, FIG. 31 shows an exemplary embodiment of a device 320 that may include a receptacle 321 containing, for example, a cosmetic product P, and an element 322 suitable for having the product P contained in the receptacle 321 pass therethrough. The element 322 may include an outside surface 323 suitable for contacting a surface of the body and/or the face onto which the product P is to be applied. The element 322 may include a sintered piece and/or any other porous material (e.g., a foam having open cells and/or a felt).

A substance, for example, a substance suitable for releasing ions on contact with the product P, may be incorporated in the element 322 during manufacture thereof and/or after manufacture (e.g. by loading the substance into the element) in a manner similar to that described with reference to the exemplary embodiment shown in FIG. 9.

Figure 32:
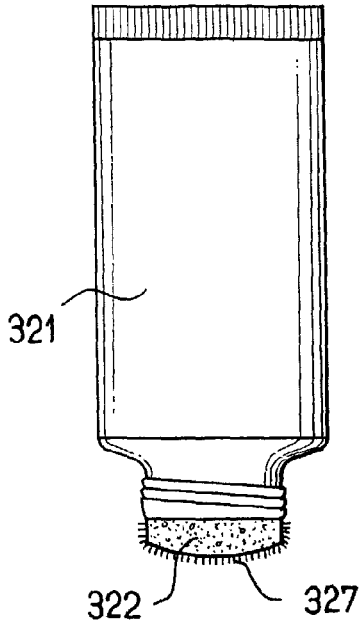
FIG. 32 is a schematic partial section view of another embodiment of a device for applying and/or packaging a product.

The element 322 may be rigid. Alternatively, it may be, for example, compressed by a closure cap fitted onto the receptacle 321, in which case, it may expand when the cap 325 is removed from the receptacle 321. The element 322 may optionally include a surface coating, for example, a flocking 327, as shown in FIG. 32.

The product P may be forced through the element 322 by, for example, squeezing the wall of the receptacle 321. In some embodiments, the receptacle 321 may include a cylindrical wall and may be fitted with a piston and a piston-driving screw mechanism. The viscosity of the product P contained in the receptacle 321 and the porosity of the element 322 may be selected such that the product P is enabled to flow via, for example, capillarity through the element 322. The viscosity of the product P may also be selected as a function of the porosity of the element 322, for example, so that the product P may be caused to pass through the element 322 only when pressure is established inside the receptacle 321. According to some embodiments, the element 322 may be movable relative to the receptacle 321, for example, by being displaceable in a housing of the receptacle against the action of resilient return structure.

An element through which the product P may be passed in order to exert a predetermined action thereon by causing a substance contained in the element to come into contact with the product P and/or by subjecting the product P to an electric field and/or a magnetic field may be fixed on a support to enable it to be removably mounted on a receptacle.

Figure 33:
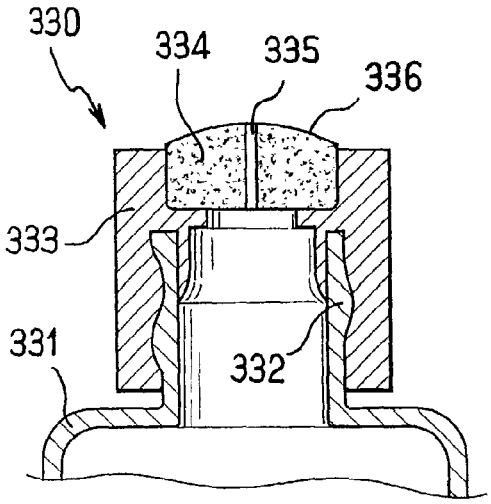
FIG. 33 is a schematic partial section view of a further embodiment of a device for applying and/or packaging a product.

For example, FIG. 33 shows an exemplary embodiment of a device 330 that may include a support 333 for carrying an element 334 and for enabling the element 334 to be removably fixed to the receptacle 331. The support 333 may be configured, for example, in such a manner so that it is suitable for coupling to a neck 332 of the receptacle 331 via, for example, screw-fastening. It may thus be possible to select one particular element 334 from a set of elements that are configured to exert different actions on contact with the product P. The element 334 may be formed from a sintered piece and/or from, for example, a foam. In some embodiments, the element 334 may include one or more openings to facilitate passage of the product P through the element 334. For example, the element 334 may include a channel 335 (e.g., centrally located) opening out into the top of an application surface 336 (e.g., an outwardly convex application surface).

Figure 34:
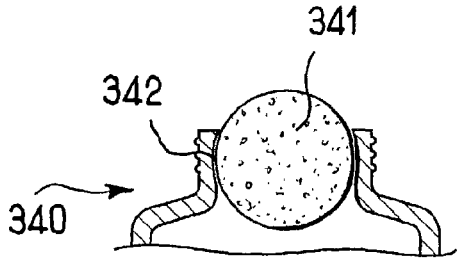
FIG. 34 is a schematic partial section view of another embodiment of a device for applying and/or packaging a product.
Figure 35:
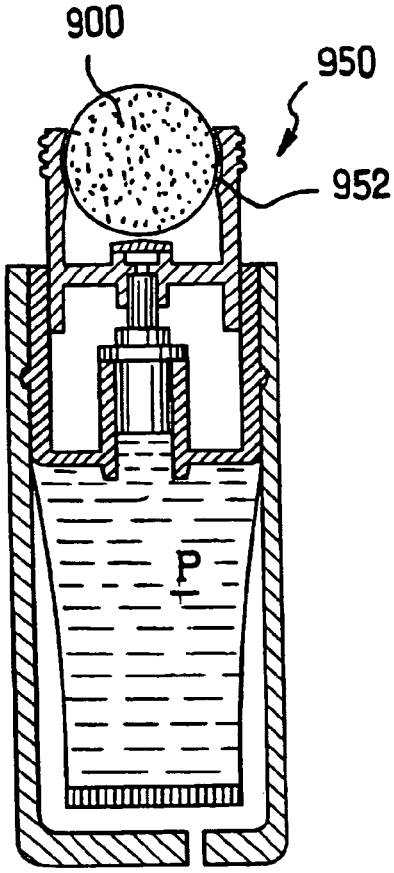
FIG. 35 is a schematic partial section view of a further embodiment of a device for applying and/or packaging a product.

FIG. 34 shows an exemplary embodiment of a device 340 that may include a rotary ball 341 received in a housing 342 of the device 340. The diameter of the rotary ball 341 may the range from, for example, about 7 millimeters to about 40 millimeters. The rotary ball 341 may include a sintered piece, it may retain at least one substance suitable for exerting an action on the product P, and the rotary ball 341 may apply the product P. The rotary ball 341 may be coupled to a removable unit, as shown in FIG. 35. For example, the exemplary embodiment of device 950 shown in FIG. 35 may include a rotary ball 900 received in a housing 952.

Figure 36:
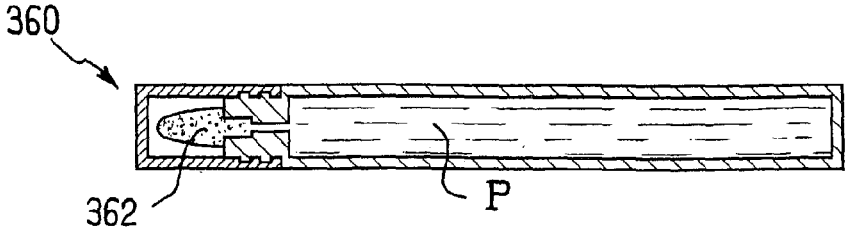
FIG. 36 is a schematic partial section view of another embodiment of a device for applying and/or packaging a product.

In some embodiments in which the element acts as an applicator, the element may have many shapes, such as, for example, it may have a pointed tip, as shown in FIG. 36. The exemplary embodiment of a device 360 shown in FIG. 36 may have the form of a pen, may include a reservoir of product P, and may communicate with a tip 362 that may include a porous material, such as, for example, a felt and/or a sintered piece that may substantially retain a substance that may be suitable for exerting an action on the product P and/or on the surface onto which the product P is applied.

Figure 37:
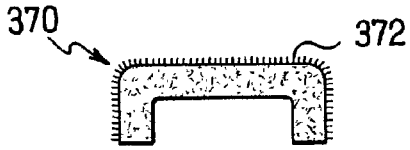
FIG. 37 is a schematic section view of a portion of a further embodiment of a device for applying and/or packaging a product.

The element may serve as an applicator and may be hollow, such as, for example, the element 370 shown in FIG. 37. The element 370 may include a sintered piece, for example, and it may have an outside surface that may be covered in flocking 372.

Figure 38:
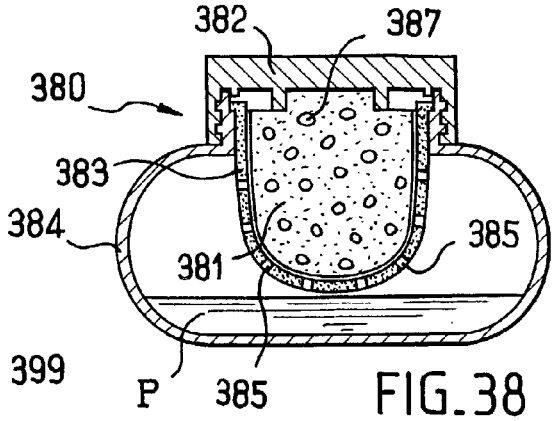
FIG. 38 is a schematic partial section view of another embodiment of a device for applying and/or packaging a product.

FIG. 38 shows an exemplary embodiment of a device 380 that may include a receptacle 384 containing a product P and a part 383 inside the receptacle that may at least partially define a housing in which an applicator element 381 may be received. The applicator element 381 may be coupled to a handle member 382 which may serve as a member for closing the receptacle 384. For example, the element 381 may include a foam material and may retain particles 387 suitable for exerting an action on the product P. The part 383 may include a material that is porous and/or permeable to the product P, and may include one or more passages 385 enabling the product P to reach the housing containing the applicator element 381. The part 383 may include a sintered piece, for example, and it may retain within itself a substance that may be suitable for acting on the product P.

Figure 39:
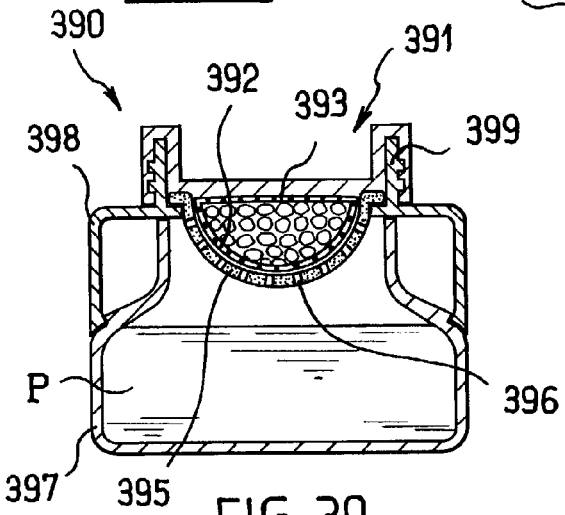
FIG. 39 is a schematic partial section view of a further embodiment of a device for applying and/or packaging a product.

The exemplary embodiment of a device 390 shown in FIG. 39 may include a receptacle 397 containing a product P and a part 398 that may be fastened (e.g., snap-fastened) thereon. Part 398 may include a neck 399 having an outside thread and supporting a cup 395 including one or more passages 396. An applicator 391 may include an element 393 serving to apply the product P that may be fixed onto the neck 399. The applicator 391 may contain a plurality of particles, such as, for example, beads, which may be at least partially retained by a product permeable wall 392 that may include, for example, a thermoformed net having a mesh size that may be small enough to substantially prevent the particles from passing therethrough. The cup 395 may define a housing enabling the element 393 to be received.

The element may be configured to exert a given action on the product P and may be received, for example, in a removable unit that may be configured to be placed temporarily in flow communication with a receptacle so as to be filled with product P and then be separated from the receptacle so that it can be taken away in a handbag, for example.

Figure 40:
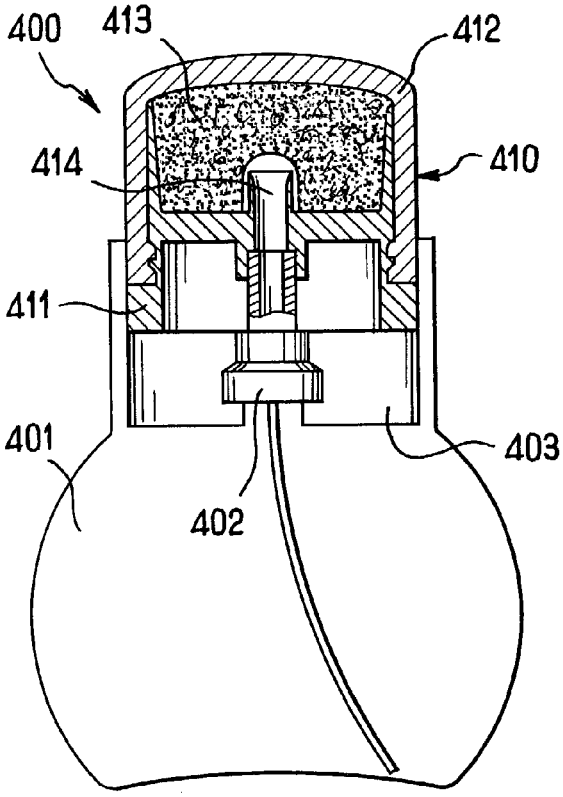
FIG. 40 is a schematic partial section view of another embodiment of a device for applying and/or packaging a product.

FIG. 40 shows an exemplary embodiment of a device 400 that may include a receptacle 401 having a pump 402. The receptacle 401 may include a housing 403 for receiving a removable unit 410. The removable unit 410 may be pushed into the housing 403 in order to actuate the pump 402. The removable unit 410 may include a first portion 411 which may act as a support for an applicator element 413 (e.g., a sintered piece and/or a foam-retaining a substance that may be configured to diffuse on contact with the product P), and a second portion 412 that may be configured to be releasably secured to the first portion 411. Cooperation between the first and second portions 411 and 412 may serve to substantially enclose the applicator element 413 in a substantially closed volume once the removable unit 410 has been separated from the receptacle 401 (e.g., while it is not in use).

According to some embodiments, a flap (not shown) may be provided on the first portion 411 in the vicinity of the inlet 414 for the product P coming from the pump 402 so as to close the volume containing the applicator element 413 in a substantially hermetic manner. The flap may be capable of opening under the effect of the pressure of the product being delivered by the pump 402.

The product P may be dispensed from a removable unit containing particles such as, for example, beads, which may be freely disposed in a housing of the removable unit.

Figure 41:
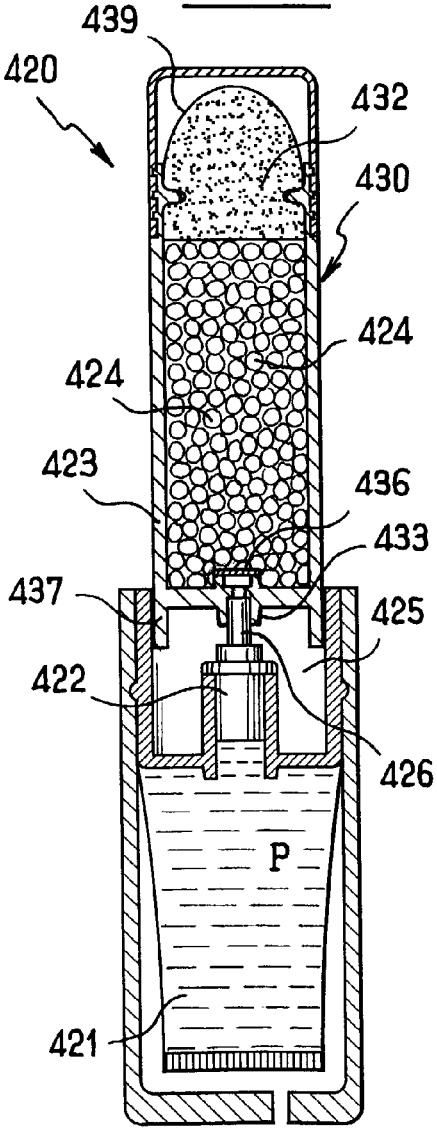
FIG. 41 is a schematic partial section view of a further embodiment of a device for applying and/or packaging a product.

FIG. 41 shows an exemplary embodiment of a device 420 into which the product P may be delivered by a pump 422 that may include a stem 426, with the product P being withdrawn from, for example, a flexible bag 421. The removable unit may be in the form of a cartridge 430 that may include a tubular wall 423 defining a housing containing particles 424 such as beads. The cartridge 430 may include a grid 436 that may be present in the vicinity of the end-piece 433 in order to retain the particles 424. The cartridge 430 may include a wall 437 for guiding its travel in the housing 425 when the pump 422 is actuated. The cartridge 430 may include an applicator surface 439 that may be loaded with product P present in the housing containing the particles 424. The applicator surface 439 may be defined, for example, by a porous applicator element 432 that may be permeable to the product P, such as, for example, a foam and/or a sintered piece.

The particles 424 may be configured to exert an action on the product P, for example, by enabling the product P to contact with one or more predetermined substances present on the surface of the particles 424. The particles 424 may be colored and the wall 423 transparent so as to produce an effect on the appearance of the cartridge 430.

The applicator element 432 may hold a substance suitable for exerting an action on the product and/or on the surface onto which the product is to be applied.

Figure 42:
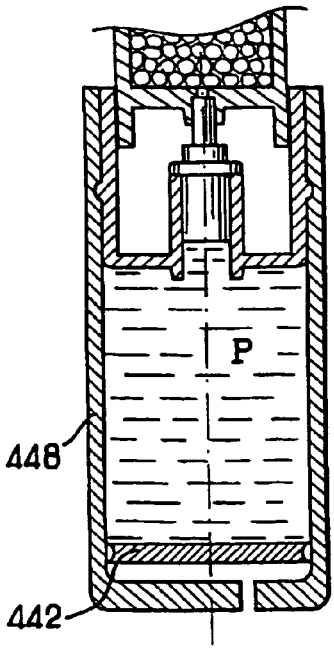
FIG. 42 is a schematic partial section view of another embodiment of a device for applying and/or packaging a product.

The product P may be contained in, for example, as shown in FIG. 42, a housing 448 that may be closed at the bottom by a piston 442. The piston 442 may be moved up as the product P is dispensed.

Figure 43:
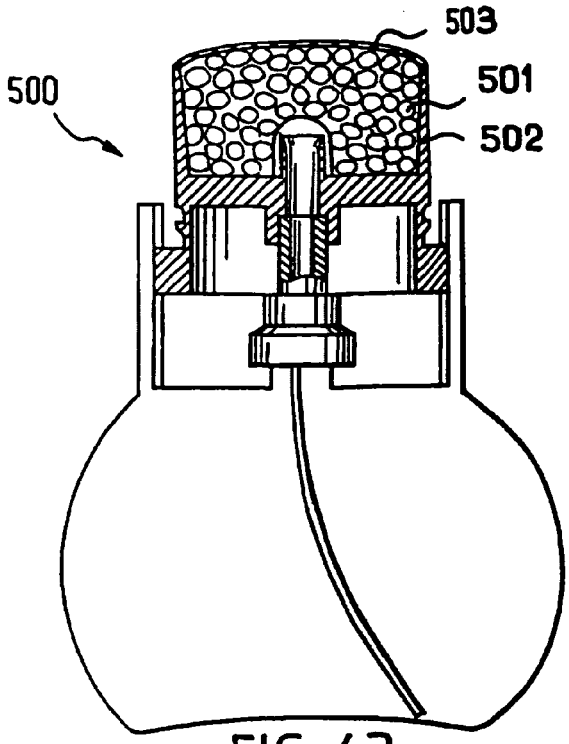
FIG. 43 is a schematic partial section view of a further embodiment of a device for applying and/or packaging a product.

The applicator element 413 of FIG. 40 may be replaced by a housing 502 containing particles 501 held in the housing 502 by a permeable wall (e.g., a grid 503), such as in the exemplary embodiment of a device 500 shown in FIG. 43.

Figure 44:
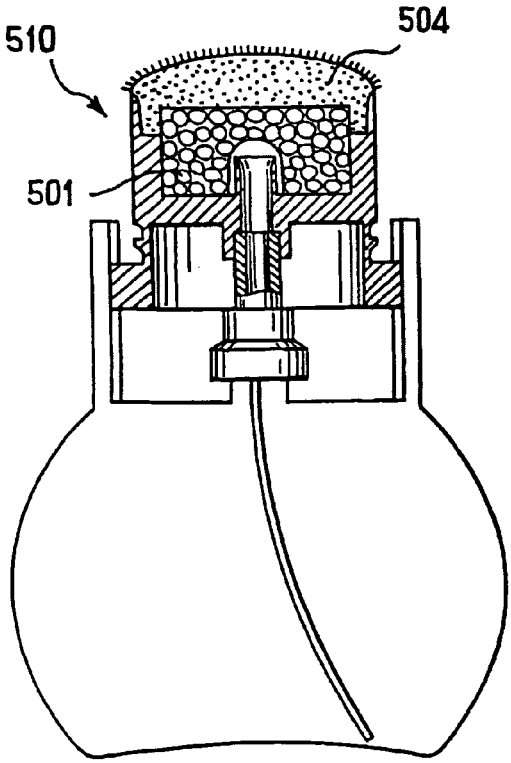
FIG. 44 is a schematic partial section view of another embodiment of a device for applying and/or packaging a product.

The grid 503 may be replaced, for example, by a flocked applicator element 504, such as in the exemplary embodiment of device 510 shown in FIG. 44. The applicator element 504 may be a sintered piece and/or a foam, for example.

Figure 45:
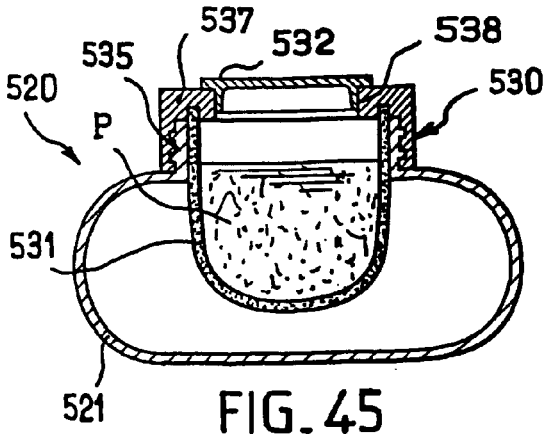
FIG. 45 is a schematic partial section view of a further embodiment of a device for applying and/or packaging a product.

The element may be configured to exert an action on the product P and/or on the surface treated with the product P, for example, in order to release a substance in contact with the product P or the surface and may define a reservoir for the product P, such as in the exemplary embodiment of a device shown in FIG. 45.

FIG. 45 shows an exemplary embodiment of a device 520 that may include an applicator 530 having an applicator element 531 defining a reservoir for a product P. The element 531 may be coupled to a closure member 537 (e.g., lid) configured to close a jar 521 in a substantially hermetic manner and the jar 521 may have, for example, a threaded neck 535. When not in use, the product P contained in the element 531 may be substantially isolated from the outside environment by the jar 521. To use the device 520, the user unscrews the applicator 530 and brings the element 531 into contact with the surface to be treated. The wall of the element 531 may be permeable to the product P such that the product P diffuses through it and reaches the surface to be treated. For example, the element 531 may include a sintered piece holding a substance that is configured to exert a given action on the product P and/or on the treated surface.

In some embodiments, an opening 538 may be formed through the closure member 537 to allow a user to introduce the product P for application. The opening 538 may be closed by a closure member 532, for example, after the product P has been inserted. The porosity of the element 531 may be selected such that the product P does not flow through the element 531. Alternatively, or in addition, the applicator 530 may be configured such that it is capable of creating increased pressure inside the reservoir defined by the element 531 so as to expel the product P through the element. The viscosity of the product P and the porosity of the element may be selected such that the product P does not pass through the element unless the pressure is increased. In some embodiments (not shown), for example, when the product P may be able to pass through the element 531, the jar 521 may be configured in the form of a case that closely fits the shape of the element 531 so as to substantially prevent the product P from escaping therefrom when not in use.

Figure 46:
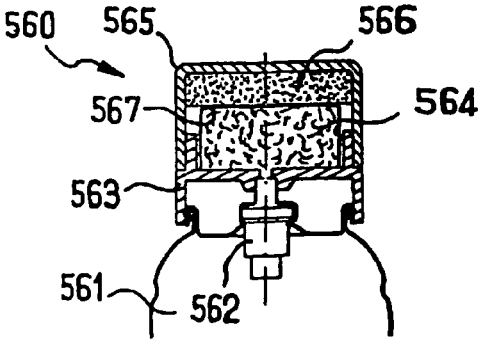
FIG. 46 is a schematic partial section view of another embodiment of a device for applying and/or packaging a product.

The element containing a substance suitable for diffusing into the product P need not itself be configured to have the product P pass therethrough, and it need not form part of an element that is applied to the skin, for example, such as the exemplary embodiment of a device 560 partly shown in in FIG. 46. The device 560 may include a pressurized receptacle 561 having a valve 562 and an applicator head 563 including an applicator element 564. A cap 565 may be configured to be fixed on the applicator head 563. The cap 565 may contain an element 566 configured to contact with a surface of the applicator element 564 when it is in place on the applicator head 563. The element 566 may be fixed in the bottom of the cap 565 and may contact with the surface 567 of the applicator element 564, which may be used to apply the product P contained in the receptacle 561. The element 566 may include a sintered piece, for example, and it may be configured to absorb the product P present in the applicator element 564 via, for example, capillarity when the cap 565 is in place on the applicator head 563. The element 566 may include a substance configured to exert an action on the product, for example, when the product contacts the substance and/or when the product P is subjected to a magnetic field and/or an electric field.

Figure 47:
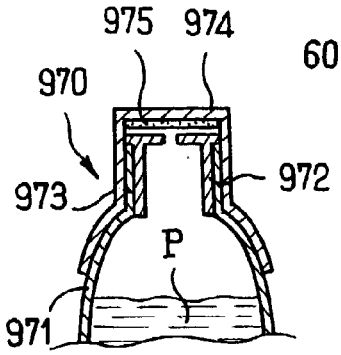
FIG. 47 is a schematic partial section view of a further embodiment of a device for applying and/or packaging a product.

The substance may be in a solid state at the end wall of a cup that may optionally serve as a closure capsule for the exemplary embodiment of a device 970, as shown in FIG. 47. The device 970 may include a receptacle 971 containing the product P, a flow reducer 972 coupled (e.g., via a friction fit) to a neck 973 of the receptacle 971, and a cup 974 placed on the neck 973. An element 975 that may contain a substance configured to diffuse in the product P may be fixed to the end wall of the cup 974.

In use, the cup 974 may be removed from the neck 973 of the receptacle 971, may then be filled with product P, and the product P may be subsequently applied (e.g. by being withdrawn by an applicator (not shown)), with the substance present next to the end wall of the cup 974 being capable of exerting an action on the product P.

Figure 48:
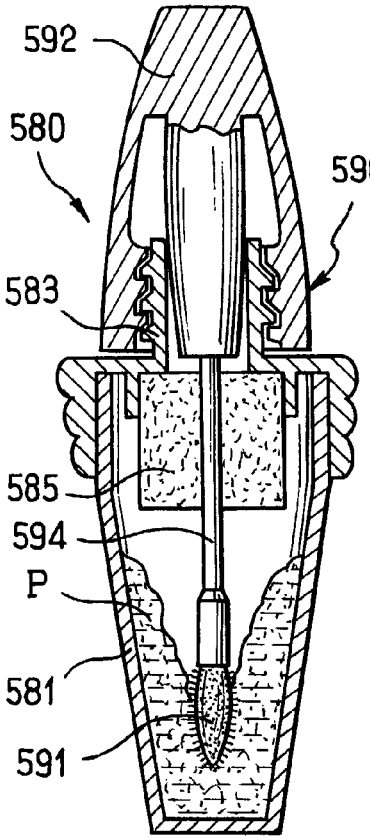
FIG. 48 is a schematic partial section view of another embodiment of a device for applying and/or packaging a product.

A substance suitable for exerting an action on the product P may be incorporated in a wiper member, as shown in FIG. 48, which shows an exemplary embodiment of a device 580 that may include an applicator 590 having a rod 594 at one end with an applicator element 591. The other end of the rod 594 may include a closure cap 592 that may serve as a handle member. The device 580 may further include a receptacle 581 having a neck 583 onto which the closure cap 592 may be coupled and a wiper member 585 enabling the applicator element 591 to be wiped as it is being withdrawn from the receptacle 581. For example, the wiper member 585 may include a block of foam that may be substantially filled with particles configured to release a given substance on contact with the product P contained in the receptacle 581. The block of foam may be formed using a plastic material that contains the substance.

Figure 49:
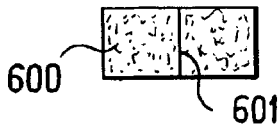
FIG. 49 is a schematic section view of a portion of a further embodiment of a device for applying and/or packaging a product.
Figure 50:
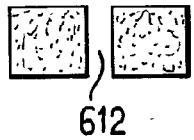
FIG. 50 is a schematic section view of a portion of another embodiment of a device for applying and/or packaging a product.

The wiper member may be substantially closed in the absence of an applicator, such as in the exemplary embodiment of a wiper member 600 shown in FIG. 49 that has a cut 601 passing therethrough. The wiper member may also have a passage 612 that remains open in the absence of an applicator, as shown in FIG. 50.

Figure 51:
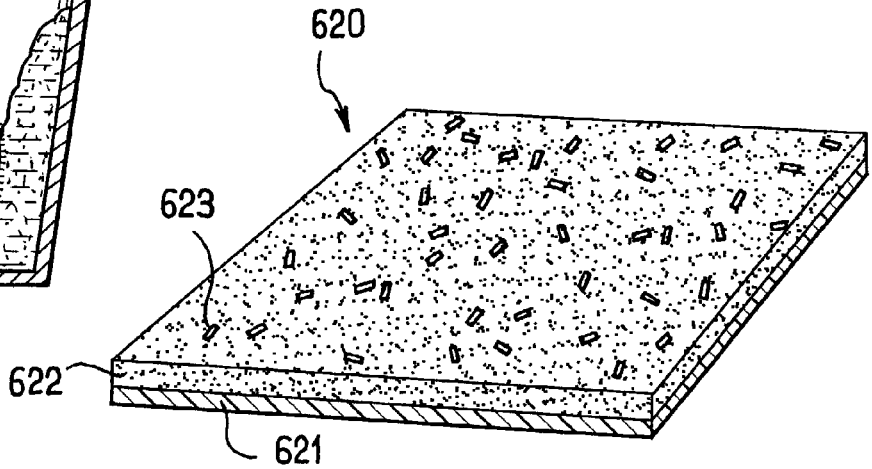
FIG. 51 is a schematic perspective view of a further embodiment of a device for applying and/or packaging a product.

The element suitable for exerting an action on the product P and/or on the surface onto which the product P is applied, may also include a sheet and/or an assembly of a plurality of sheets. For example, FIG. 51 shows an exemplary embodiment of a sheet 620 that may include a matrix 622 (e.g., a polymer matrix), that may contain particles 623 configured to exert a given action. The matrix 622 may be bonded via one face to a backing sheet 621 which may be waterproof or otherwise. The sheet 620 may include a product P suitable for diffusing into the skin, and the particles 623 may be suitable for releasing a substance on contact with the product P.

In some embodiments, the sheet 620 may be configured to be impregnated in a product P at the time of use, for example, a product P that is poured onto the backing 621 (e.g., if the backing is porous and if it is configured to absorb the product P).

Figure 52:
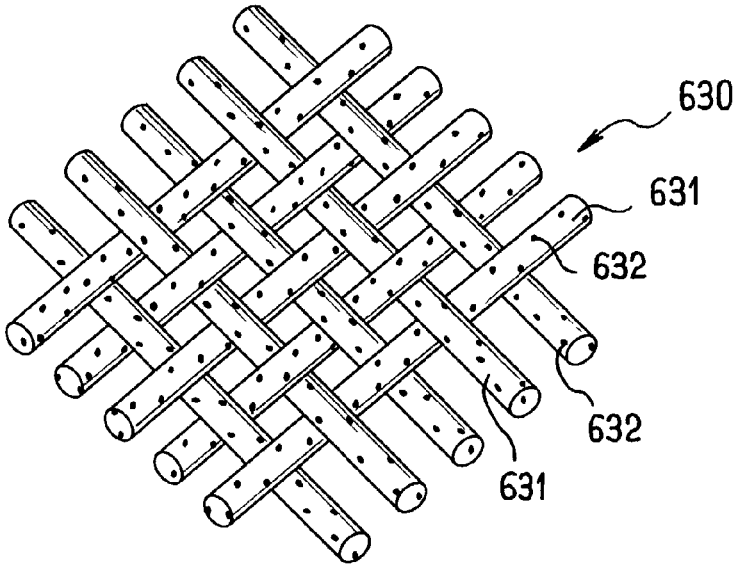
FIG. 52 is a schematic view of a portion of another embodiment of a device for applying and/or packaging a product.

In the exemplary embodiment shown in FIG. 51, the particles 623 are held in the matrix 622. Alternatively, the particles 623 may be held within a woven and/or non-woven cloth. For example, FIG. 52 shows an exemplary embodiment of a sheet of woven cloth 630 that may include fibers 631 in which particles 632 configured to exert an action on the product P and/or on the surface treated with the product P are held.

Figure 53:
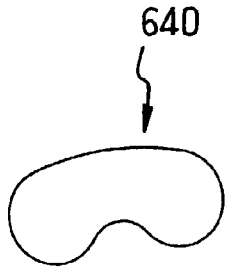
FIG. 53 is a schematic view of a further embodiment of a device for applying and/or packaging a product.
Figure 54:
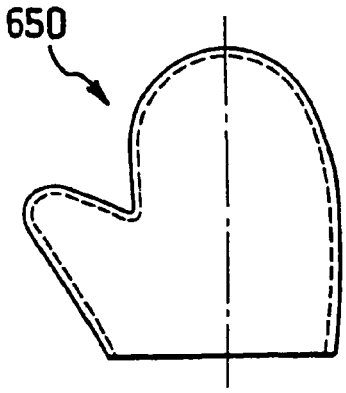
FIG. 54 is a schematic view of another embodiment of a device for applying and/or packaging a product.
Figure 55:
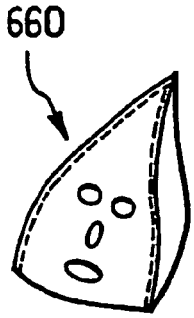
FIG. 55 is a schematic view of a further embodiment of a device for applying and/or packaging a product.
Figure 56:
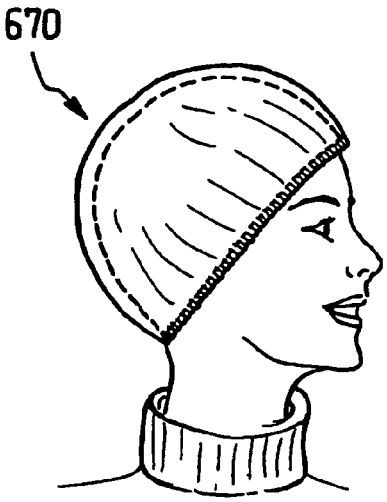
FIG. 56 is a schematic view of another embodiment of a device for applying and/or packaging a product.

The sheet holding the particles 632 may be cut so as to form a mask 640, as shown in FIG. 53. The sheet may also be coupled to another sheet (e.g., a sheet having a substantially identical structure) so as to form a glove 650, as shown in FIG. 54. The sheet may also be assembled with other sheets so as to form a hood 660, as shown in FIG. 55, or a cap 670, as shown in FIG. 56.

In at least some of the embodiments described above, it may be possible to use particles that include a variety of structures, which may be free or otherwise, agglomerated using a binder, sintered, and/or incorporated in any material whatsoever, for example, in a plastic material and/or an inorganic material, which may be cellular and/or solid. For example, it may be possible to use particles having a composite structure (e.g., particles comprising at least one core including a first material and surrounded at least in part by a covering including a second material).

Figure 57:
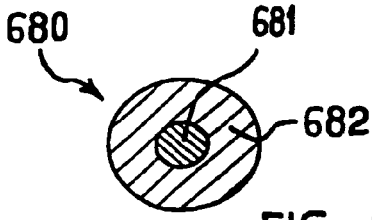
FIG. 57 is a schematic section view of an embodiment of a particle.
Figure 58:
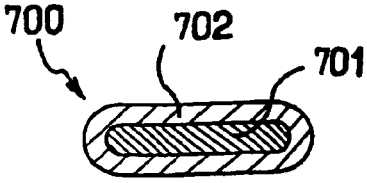
FIG. 58 is a schematic section view of another embodiment of a particle.

For example, an exemplary embodiment of a coated particle 680 is shown in FIG. 57. The particle 680 may include a core 681 and a covering 682. As shown in FIG. 57, the particle 680 may be substantially spherical, although other shapes of particles are contemplated. For example, the particles could be substantially elongate in shape, as shown in FIG. 58. FIG. 58 shows an exemplary embodiment of a particle 700 that may include a core 701 and a covering 702 having an elongate shape. The core 701 may be include a fiber, for example, a vegetable fiber or a wood fiber.

Figure 59:
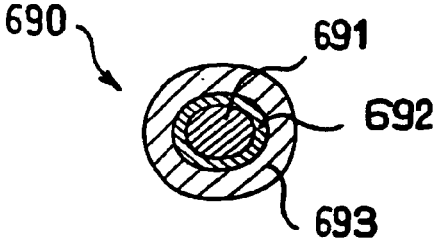
FIG. 59 is a schematic section view of a further embodiment of a particle.

The particles may also include more than two layers, for example, a structure having three layers, as shown in FIG. 59. FIG. 59 shows an exemplary embodiment of a particle 690 having a core 691, a covering 693, and an intermediate layer 692. The intermediate layer 692 may serve to make the core 691 electrically conductive so as to enable the covering 693 to be deposited electrochemically. The core 691 may include a material that does not conduct electricity, for example, wood, glass, and/or a ceramic, and the intermediate layer 692 may include a metal oxide, for example, a ferrite, so as to confer a degree of electrical conductivity to the core 691. The conductivity may be sufficient to substantially enable the covering 693 to be deposited thereon electrochemically (e.g., when the material of the covering includes, for example, a metal, such as silver and/or copper).

Figure 60:
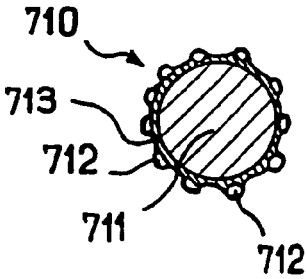
FIG. 60 is a schematic section view of another embodiment of a particle.

FIG. 60 shows an exemplary embodiment of a particle 710 that may include a core 711 having grains 712 deposited thereon. The grains 712 may include a substance that is suitable for exerting an action on the product P and/or on the surface treated with the product P. The grains 712 may be secured to the core by a binder 713, for example, a resin.

Figure 61:
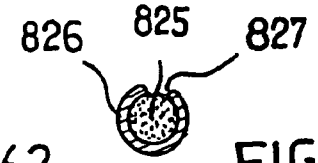
FIG. 61 is a schematic section view of a further embodiment of a particle.

FIG. 61 shows an exemplary embodiment of a particle that may include a hollow covering 826 containing the substance 825 that is configured to diffuse into the product P and/or that is configured to act thereon in some other way. The covering 826 may include at least one opening 827 enabling the substance to contact the product P. The covering 826 may include a hollow microsphere of glass.

Particles suitable for exerting an action on the product P and/or on the treated surface may be retained, for example, in fibers, foams, sintered pieces (e.g., ceramics and/or pieces including plastic materials other than foams). According to some embodiments, these elements may be subjected to, for example, abrasives serving to expose the particles present in the vicinity of the surface of the element to the product P.

For example, fibers and/or foams may be formed from a first material in which grains of a second material different from the first material may be dispersed, for example, the grains of second material may be selected so as to be capable of diffusing into the product P on contact therewith.

Figure 62:
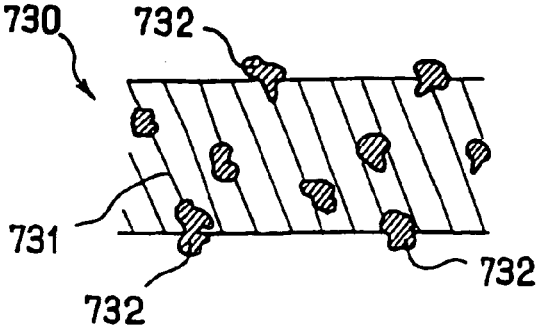
FIG. 62 is a partial schematic section view of an embodiment of a fiber.

FIG. 62 shows an exemplary embodiment of a fiber 730 that may be formed by extruding a thermoplastic material 731. The fiber 730 may include grains 732 of a metal and/or a metal oxide dispersed therein. The fibers incorporating particles suitable for exerting an action on the product P may be used, for example, for making a mascara brush.

Figure 63:
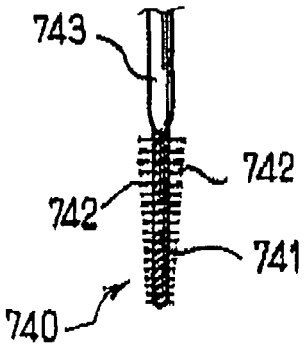
FIG. 63 is a partial schematic view of a further embodiment of a device for applying and/or packaging a product.

FIG. 63 shows an exemplary embodiment of a mascara brush 740 that may include a rod 743 having a core 741 coupled to one end thereof. The core 741 may be formed by two branches of metal wire that are twisted together and may hold bristles 742 that may include particles suitable for exerting an action on the product P and/or on the treated surface.

Figure 64:
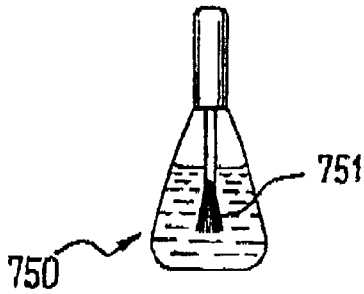
FIG. 64 is a schematic view of another embodiment of a device for applying and/or packaging a product.

The fibers may be included in a brush 751 that may enable nail varnish to be applied, such as in the exemplary embodiment of a device 750 shown in FIG. 64.

Figure 65:
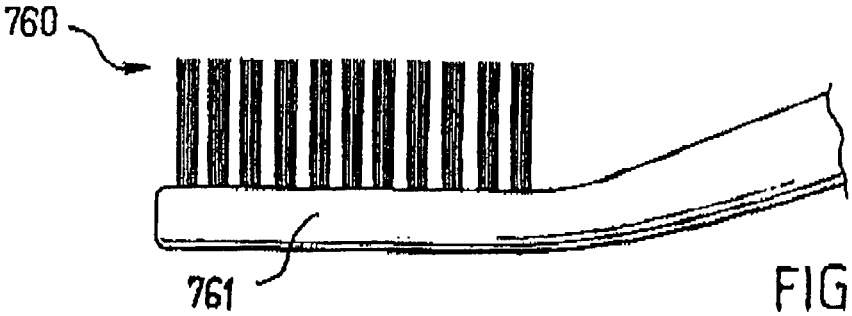
FIG. 65 is a partial schematic view of a further embodiment of a device for and/or packaging applying a product.

The fibers may also be disposed on a support 761, thereby forming a brush (e.g., a toothbrush 760), as shown in FIG. 65.

Figure 66:
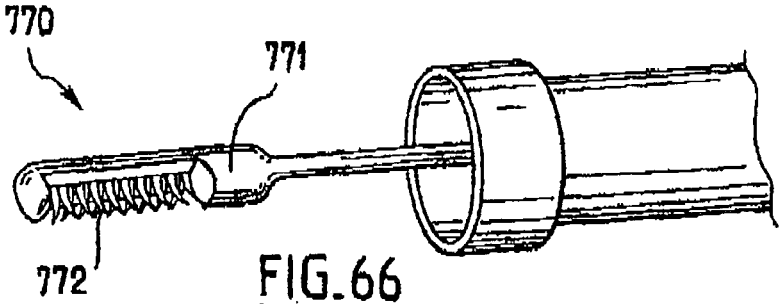
FIG. 66 is a partial schematic perspective view of another embodiment of a device for applying and/or packaging a product.

The particles suitable for exerting an action on the product P and/or the surface onto which the product P is applied, may also be incorporated in a plastic material used to make a comb, for example, a comb for the eyelashes or the eyebrows. FIG. 66 shows an exemplary embodiment of a comb 770. The comb 770 may include a support 771 having teeth 772 connected thereto. The teeth 772 may include the particles.

Figure 67:
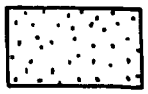
FIG. 67 is a schematic section view of a portion of a further embodiment of a device for applying and/or packaging a product.
Figure 68:
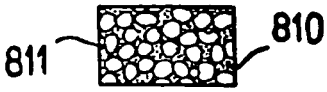
FIG. 68 is a schematic section view of a portion of another embodiment of a device for applying and/or packaging a product.

Particles that are suitable for exerting an action on the product P and/or on the treated surface may be incorporated into a vitrified material, as shown in FIG. 67, or in the pores 810 of a porous material that includes particles 811 that are sintered together and/or agglomerated by means of a binder (e.g., a resin), as shown in FIG. 68.

Figure 69:
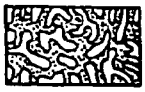
FIG. 69 is a schematic section view of a portion of a further embodiment of a device for applying and/or packaging a product.

The particles suitable for exerting an action on the product P and/or the treated surface may also form part of the composition of a porous material, as shown in FIG. 69.

Figure 70:
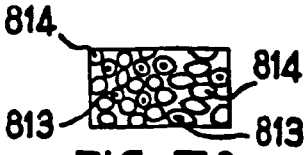
FIG. 70 is a schematic section view of a portion of another embodiment of a device for applying and/or packaging a product.

The element may also include particles 813 (e.g., coated particles) that may include the substance suitable for exerting an action on the product P and/or on the treated surface, along with particles 814 that do not exert any such action, as shown in FIG. 70. In this exemplary embodiment, the particles 813 and 814 may be sintered and/or agglomerated together by a binder, for example, by a resin, so as to constitute a porous structure.

Figure 71:
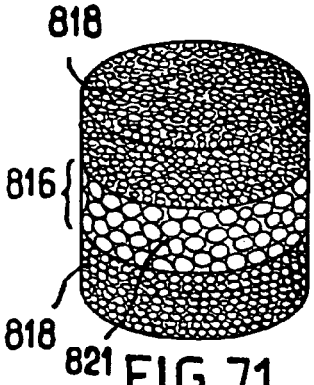
FIG. 71 is a schematic perspective view of a portion of a further embodiment of a device for applying and/or packaging a product.

The particles suitable for exerting an action on the product P and/or on the treated surface may also include a porous layer 816 sandwiched between layers 818 of different types, as shown in in FIG. 71. The layers 818 may be identical in composition or different, they may optionally be inert relative to the product P, and they may be porous, for example, they may include sintered pieces. The particles of the layer 816 may be held together by a binder 821, which may be organic or inorganic, although the particles may be held together in other ways.

Figure 72:
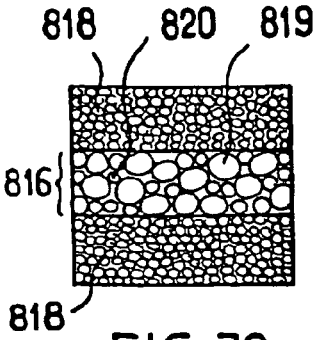
FIG. 72 is a schematic section view of a portion of another embodiment of a device for applying and/or packaging a product.
Figure 73:
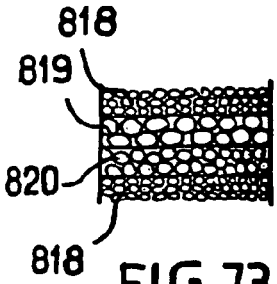
FIG. 73 is a partial schematic section view of a portion of a further embodiment of a device for applying and/or packaging a product.

The layer 816 may include two types of particles 819 and 820, respectively, for example, containing two different substances, and they may have different sizes, as shown in FIG. 72. In some embodiments, various kinds of particles need not be mixed together within a single layer, but may form strata, as shown in FIG. 73. This may render it possible, for example, to charge the product P with a variety of substances as it passes through the element.

Figure 74:
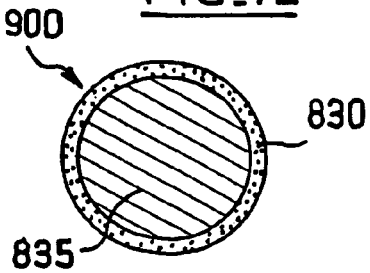
FIG. 74 is a schematic section view of a portion of another embodiment for applying and/or packaging a product.

The substance suitable for exerting an action on the product P and/or on the treated surface may also be included in the covering of a coated body. For example, FIG. 74 shows an exemplary embodiment of an element 900 that may include a body 835 and a covering 830 containing a substance that is configured to exert an action on the product P. The substance may be in the form of particles 831 dispersed in a binder 836, for example, as shown in FIG. 75. The binder may be permeable to a least one of the components of the product P so as to enable a substance contained in the particles 831 to diffuse into the product P. The element 900 may be subjected to an abrasive treatment for the purpose of exposing particles 831 to the product P.

The layer 830 may include first particles 831 that contain the substance, and other particles 832 that contain a second substance, as shown in FIG. 76.

The layer 830 may include coated particles 833, as shown in FIG. 77, and/or particles that differ in other ways, as described above with reference to FIGS. 57 through 61.

The element 900 may include a body and a covering surrounding the body, with the covering being active with respect to the product P and/or the treated surface, but the element may also be formed as a single piece of the same material, which may have particles embedded therein (e.g., in a binder), and particles that may be suitable for exerting an action on the product P. Regardless of whether element 900 includes a coated body, the element 900 may have, for example, a spherical in shape. The element 900 could have various other shapes, for example, any one of the shapes shown in FIGS. 78 through 92.

The element, as shown in FIG. 74 and FIGS. 78 through 92, may have a size, for example, ranging from about 7 millimeters to about 40 millimeters.

The element may be in the form of a ring, as shown in FIG. 78, a shutter, as shown in FIG. 79, a tube, as shown in FIG. 80, a polyhedron, as shown in FIG. 81, a pillar, as shown in FIG. 82, and a rectangular block, as shown in FIG. 83.

The element 900 may include one or more cavities that may be visible to the naked eye, for example, that may serve to increase the exchange surface area of the element 900 with the product P. For example, FIGS. 82 and 83 depict exemplary embodiments of element 900 that may include cavities 901 formed by at least one borehole. The cavities 901 may also be formed, for example, as annular grooves extending between fins 902 (e.g., disk-shaped fins) united by a central core 903, as shown in FIG. 84.

FIGS. 85 and 86 are, respectively, a perspective view and an equatorial section view of a body 900 having a spherical envelope and cavities 901 defined by grooves that may extend parallel to meridians.

According to some embodiments, element 900 may include only one cavity.

FIG. 87 shows an exemplary embodiment of an element 900 having a spherical envelope surface that may include cavities 901, each occupying approximately one-fourth of a hemisphere, and being separated by partitions 903, each forming one-fourth of a disk.

The element 900 may have a through borehole 904 extending along a diameter, for example, as shown in half-axial section in FIG. 88.

The element 900 may define a hollow body having an internal cavity 905 communicating with the outside via an opening 906 (e.g., a single opening), as shown in FIG. 89.

The element could define an envelope of a shape other than a spherical shape. For example, FIG. 90 shows an exemplary embodiment of an element 900 that may be generally annular in shape with a central hole 908 and annular grooves 909 defining fins 910 therebetween.

The element 900 may be generally in the form of a polyhedron, as shown in FIGS. 91 and 92.

The element 900 shown in FIG. 91 may be substantially in the form of a rectangular block having cavities that may include holes 911 and spaces situated between ribs 912.

The element 900 shown in FIG. 92 may include a through hole 913 having a rectangular section, and fins 914 defining cavities 915 between one another.

FIG. 84 shows an exemplary embodiment of an element 900 that may include, for example, a molded plastics material that may incorporate particles that are configured to exert an action on the product P within the plastic material prior to forming the body. For example, the plastic material may be selected from: polypropylenes (PPs), polystyrenes (PSs), PEs, PAs, PA6s, PETs, polyoximethylenes (POMs), methacrylates, urea-formaldehydes, melamines, cyanoacrylates, polyacrylates, although other plastic materials are contemplated.

For example, the element may include from about 5% to about 90% by weight of the particles, and, for example, from about 10% to about 75% (e.g., more than about 50% or about 60%). The size (e.g., greatest width dimension (for example, diameter) of the particles incorporated in the plastic material may range, for example, from about 0.1 micrometer to about 200 micrometers (e.g. from about 1 micrometer to about 20 micrometers (e.g., about 10 micrometers)).

The element 900 may include cavities that are disposed such that the element 900 is enabled to be un-molded easily during manufacture, for example, to make it possible to use a mold having only two portions.

After molding, the element 900 may be subjected to treatment for eroding its surface so as to enable particles to come directly into contact with the product P. For example, the element 900 may be inserted into a drum along with an abrasive agent such as sand, and the drum may be rotated a sufficient length of time.

The element 900 may include ceramic materials.

The substance suitable for exerting an action on the product P and/or the treated surface may be held in the solid state within the element 900 (e.g., in the form of particles that may be dispersed, for example, substantially uniformly in a polymer and/or an inorganic matrix) with a portion of the particles situated in the vicinity of the surface of the body being at least partially in direct contact with the product P.

The element 900 may be used, for example, as a stirrer. For example, FIG. 93 shows an exemplary embodiment of a device 920 that may include a receptacle 921 containing the product P, an element 900 that may be immersed in the product P and free to move therein. The element 900 may be suitable for use whenever it is desired for the product P to be homogenized, for example, by shaking the receptacle 921. The receptacle 921 may include a neck 922 that may have a flow reducer 923 including an inside sealing lip 924 and a skirt 925 having an outside thread for enabling a closure cap 926 to be secured thereto.

FIG. 94 shows an exemplary embodiment of a device that may include a plurality of elements 900 that may have, for example, different dimensions, and/or different shapes. The elements 900 may include binders and/or particles that are different from each other.

The elements 900 may be permanently immersed in the product P, or they may be configured to contact the product P only at the time of application and/or when the product P is dispensed.

For example, FIG. 95 shows an exemplary embodiment of a device 930 that may include a receptacle 931 and a flow reducer 932 (e.g., snap-fastened to the receptacle 931). The flow reducer 932 may define a housing 933 containing the element 900. FIG. 95 shows that the element 900 may be situated above the level of the product P, for example, while the device 930 is upright on a horizontal planar surface. The element 900 may optionally be free to rotate in the housing 933. The receptacle 931 may be closed by a closure cap 935, for example, having a central sealing skirt 936 cooperating with the opening of the housing 933.

When the receptacle 931 is, for example, substantially inverted to dispense the product P, the product P flows through the passage(s) formed between the edges of the housing 933 and the surface of the element 900. The passage(s) may become charged with one or more substances released by particles present at the surface of the element 900.

The element 900 may be held against a seat by the skirt 936, for example, when the receptacle 931 is closed, thus enabling an orifice 937 through which the product P penetrates into the housing 933 to be closed when the device is not in use.

FIG. 95 shows an exemplary embodiment of an element 900 that may be held by cooperating shapes in a spherical portion of the housing 933, although it is contemplated that the element 900 may be held in the housing by a separate fitting.

FIG. 96 shows an exemplary embodiment of a device 940 that may include a receptacle 941 having an intermediate piece 942 coupled thereto that may define a housing 943 configured to contain the element 900. The element 900 may be held in the housing 943 by a closure capsule 946 coupled to the receptacle 941. The capsule 946 may include a hinge 947 (e.g., a film hinge) connecting together a base portion 945 coupled to the receptacle 941 (e.g., via snap-fastening), and a pivotally mounted lid 948.

Particles used in at least some of the exemplary embodiments described above may include and/or be constituted by a substance suitable for diffusing on contact with the product P, for example, by releasing ions (e.g., for the purpose of conferring antiseptic properties, regenerative properties, healing properties, and/or properties that encourage blood circulation, to the product P).

The release of silver ions may serve, for example, to reduce the preservative content of the product P, and/or may render it possible to use substantially no preservative(s).

The substance may include at least one material selected from, for example, metals, metal alloys, chromium, aluminum, silver, copper, manganese, bronze, titanium, cobalt, barium, metal salts, metal oxides, iron oxides, ferrites, silicates, sulfates, carbonates, calcium carbonate, non-ferrous compounds, sulfur, magnesium, calcium, boron, potassium, carbon, oligoelements, mineral salts, metallic salts, rock salts, sea salts, clays, algaes, planktons, algae extracts, plankton extracts, roots, licorices, gingers, waxes, oils, bactericides, vitamins, proteins, acids, hormones, collagens, alums, alum stones, silks, hemps, and glucoses.

For example, the substance may include a covering of the particles 680, 690, 700, 826, as shown in FIGS. 57 through 59. The substance may also include the core, for example, when the covering is not completely impermeable to the product P and to the substance. In order to constitute the cores of particles, it may be possible, for example, to use a substrate including at least one material selected from silicas, colloidal silicas, sands, aluminas, steatites, sandstones, titanium oxides, zirconium oxides, glasses, ceramics, corks, woods, cork fibers, cork powders, wood fibers, wood powders, lavas, silicates, galenas, oxides, hemps, flaxes, silks, clays, porcelains, corns, maizes, wheats, rice fibers, micas, PEs, PETs, PUs, PVCs, PAs, EVAs, vinyls, urea formaldehydes, epoxies, polyesters, elastomers, cyanoacrylates.

It may also be possible to use the materials in the above list to form a binder that may enable an element to be made such that it includes particles containing the substance, for example, one of the elements 900 shown in FIGS. 78 through 92.

For example, an element 900 (e.g., presenting the shape shown in FIG. 84) may be formed by injection molding a material having about 30% by weight polyamide 6, about 69.5% by weight alumina power, and about 0.5% by weight silver and/or copper salts. The element 900 may have antibacterial virtues by diffusing ions of silver and/or copper into the product P, thus rendering it possible to reduce the quantity of preservative(s) used in, for example, the product P.

The element may also be formed, for example, with about 60% clay powders, about 10% ferrite powders, and about 30% polypropylenes (the percentages being expressed as weight percentages). The element may be magnetized in order to further to present magnetic properties.

In another example, the element may include, for example, about 1% to about 80% alumina powders, for example, about 15% to about 70% alumina powders, along with a moisture absorber.

For example, the element may further contain about 5% to about 80% by weight of a silver and alumina powders mixture, for example, about 10% to about 75% of a copper alumina powder mixture.

According to some embodiments, the particles used may also have virtually no contact with the product P and may merely exert a field, for example, a magnetic field and/or an electric field, remotely on the product P and/or on the surface treated with the product P.

According to some embodiments, for example, those described with reference to FIGS. 42, 43, 95, and/or 96, the device may be configured so as to enable the user to see the element, which may, for example, look like a ball. For example, the device may include a distribution member being, at least in part, transparent and/or translucent, so as to enable the user to see the element therethrough so that the attractiveness of the device may be improved. In some embodiments, the user may be able to see the circulation of the product P between the element and the walls of the housing receiving the element during application of the product P by virtue of at least local transparency of the device.

In some embodiments, the device may include a distribution member having two covers, a first cover which may enable the user to open and to close an outlet orifice and a second cover which may provide access to the element. The accessibility to the element may enable, for example, the user to replace it (e.g., at the end of its life and/or to replace it with another element having different properties).

For example, FIG. 97 partially shows an exemplary embodiment of a device 995 similar to the device shown in FIG. 19. The device 995 may include a receptacle 984 and an element 994 that may be received in a housing defined by the walls of the inside neck 982 of a closure capsule 983 without being fixed to the neck 982. The element 994 may be held by a lower shoulder 997 of the neck 982 and by a flap 996 of the bottom portion 998 of the closure capsule 983, which may also include a closure lid 999.

The flap 996 may be, for example, a pivoting flap that may be linked to the remainder of the closure capsule 983 by a non-apparent hinge (e.g., a film hinge). To insert the element 994 into the device, the user may pivot the flap 996. During use, the product P may flow and contact the element 994, and exit through an opening of the flap 996. This opening may be closed by the closure lid 999, for example, when the device is not in use. The flap 996 may be substituted by a piece entirely separable from the closure capsule 983.

The element may or may not be in permanent communication with the product P. The device may include, for example, a valve member enabling the closing and opening of a flow communication between a receptacle containing the product P and the element. The valve member may be moved, for example, from its closed position to its open position by a rotation and/or a translation movement. In such an exemplary manner, the product P may be stored separately from the element until, for example, the first use.

For example, FIG. 98 shows an exemplary embodiment of a device 1000 that may include a bottom portion 1003 for coupling to a neck 1002 of a receptacle, and a top portion 1004 configured to be rotated relative to the bottom portion 1003 between a closed position and an open position.

The bottom portion 1003 may include an assembly skirt 1005, for example, threaded onto the neck 1002, and a sealing lip 1006 abutting in a substantially leak-tight manner against the inside surface of the neck 1002. The bottom portion 1003 may also include an inside skirt 1007 against which an outside skirt 1008 of the top portion 1004 may be fastened (e.g., snap-fastened). The bottom portion 1003 may include two concentric tubular walls 1010 and 1011 that may be interconnected by bridges of material that may define one or more openings 1013 between the walls 1010 and 1011. The inner wall 1010 may be substantially closed at an intermediate height by a transverse wall 1014, and may include a lateral opening 1015 above the transverse wall 1014.

The top portion may include a tubular wall 1016 extending between the walls 1010 and 1011. The tubular wall 1016 may include a lateral opening 1017 which may be substantially aligned with the lateral opening 1015, for example, when the top portion 1004 is rotated into a dispensing position. The product P may then be permitted to flow between the walls 1010 and 1011, through the lateral openings 1015 and 1017, into the inside of the wall 1016, and above the transverse wall 1014, until it reaches the element 1025, which may be disposed, for example, in a housing 1020 of the top portion 1004. When the top portion 1004 is in its closed position, the tubular wall 1016 closes the lateral opening 1015, thereby closing the receptacle.

Although the element has been represented in the exemplary embodiment shown in FIG. 98 by a sintered piece and/or a foam element, the use of other types of elements is contemplate, for example, those described previously herein.

At least some of the exemplary embodiments described above may render it possible to make use of antiseptic, purifying, cleansing, and/or circulation-promoting properties, although other properties are contemplated, and/or to make use of natural substances and/or substances of natural origin, such as, for example, metals and/or oxides, by diffusing them into a product, such as a cosmetic product and/or care product. The quantity of substance that diffuses into the product may be relatively small or large as a function of, for example, the solubility of the substance in the product. The substance may diffuse into the product in the trace state.

It may be possible, using at least some of the exemplary embodiments of the invention described previously herein, to confer given properties into a product P without the need to introduce a particular substance conferring the properties to the product P during the initial formulation of the product P. The invention may thus render it possible, for example, for the product P to have introduced therein a substance which would be incompatible with conservation of the product P over a long duration and/or which would require additional components to be introduced into the product P.

The substance may also have catalytic properties and/or enzymatic properties enabling chemical and/or biological reactions to take place in the product P.

The product P may possess a wide variety of properties and/or natures. For example, the product P may be a liquid, a powder, a gel, and/or a cream. The product P may, for example, include an aqueous solution, an alcohol solution, an oil, and/or an emulsion. The product P may also result from contacting a liquid with a body that is suitable for dispersing upon contact with the liquid.

The device according to some exemplary embodiments of the invention may be used to apply and/or package cosmetic products and/or care products, such as make-up products, dermatological substances, and/or pharmaceutical compositions used for treating and/or changing the appearance of, for example, hair, skin, and/or nails. However, in its broadest aspects, the present invention could be used to apply and/or package many other products.

Furthermore, sizes and configurations of various structural parts and materials used to make the above-mentioned parts are illustrative and exemplary only, and one of ordinary skill in the art would recognize that these sizes, configurations and materials can be changed to produce different effects or desired characteristics.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. A device for at least one of applying at least one of a cosmetic product and a care product to a surface and packaging the at least one of a cosmetic product and a care product, the device comprising:

a reservoir containing the at least one of a cosmetic product and a care product; and at least one element comprising a plurality of particles, and a portion permeable to the at least one of a cosmetic product and a care product, the portion at least partially defining a hollow structure comprising an inner space configured to retain the plurality of particles, wherein an interior surface of the hollow structure contacts at least some of the plurality of particles, wherein the at least one element is configured such that the plurality of particles comprise at least one substance, and at least one of the at least one of a cosmetic product and a care product and the surface receiving the at least one of a cosmetic product and a care product is enabled to contact the at least one substance, and the device is configured such that the at least one of a cosmetic product and a care product is capable of penetrating the inner space configured to retain the plurality of particles; and/or the at least one element generates at least one of an electric field and a magnetic field, and at least one of the at least one of a cosmetic product and a care product and the surface receiving the at least one of a cosmetic product and a cosmetic product is enabled to be subjected to the field generated by the at least one element and wherein the particles differ from the at least one of a cosmetic product and a care product.

2. The device of claim 1, wherein the particles comprise at least one bead.

3. The device of claim 2, wherein the at least one bead is compressible.

4. The device of claim 1, further comprising at least one bead, the at least one bead comprising at least one of the particles.

5. The device of claim 4, wherein the at least one bead is compressible.

6. The device of claim 1, wherein at least one of the particles is free in the inner space at least partially defined by the portion of the at least one element.

7. The device of claim 1, wherein the portion of the at least one element comprises a sachet configured to retain the particles.

8. The device of claim 1, wherein the at least one element comprises a surface configured to apply the at least one of a cosmetic product and a care product to at least one of skin, hair, finger nails, and toe nails.

9. The device of claim 1, further comprising a handle member coupled to the at least one element.

10. The device of claim 9, wherein the handle member is configured to be coupled in a substantially leak-tight manner to the reservoir.

11. The device of claim 9, wherein the handle member is configured to be mounted on the reservoir, and the device is configured such that the at least one element and the reservoir are in flow communication with one another when the handle member is mounted on the reservoir.

12. The device of claim 1, wherein the at least one substance is in a solid state in the at least one element at least prior to the at least one element contacting the at least one of a cosmetic product and a care product.

13. The device of claim 1, wherein the particles define a size ranging from about 0.1 micrometers to about 7 millimeters.

14. The device of claim 1, wherein at least one of the particles comprises a hollow particle at least partially filled with the at least one substance.

15. The device of claim 1, wherein at least one of the particles comprises a coated particle having a core comprising a first material and a covering extending substantially around the core and comprising a second material, wherein the first material differs from the second material.

16. The device of claim 15, wherein the covering comprises the at least one substance.

17. The device of claim 15, wherein a surface of the covering comprises the at least one substance.

18. The device of claim 15, wherein the core comprises the at least one substance.

19. The device of claim 18, wherein the at least one substance is configured to exert at least one of an electric field and a magnetic field on the product.

20. The device of claim 1, wherein the at least one element comprises at least one porous layer, wherein the at least one porous layer is permeable to the at least one of a cosmetic product and a care product and comprises the particles.

21. The device of claim 20, wherein the at least one porous layer comprises a mixture of particles having differing characteristics, wherein at least some of the mixture of particles comprise the at least one substance.

22. The device of claim 20, wherein the at least one porous layer comprises a mixture of particles having different sizes.

23. The device of claim 20, wherein the particles of the at least one porous layer are agglomerated by a binder.

24. The device of claim 20, further comprising two layers comprising a material configured to be permeable to the at least one of a cosmetic product and a care product, wherein the at least one porous layer is positioned between the two layers.

25. The device of claim 1, wherein the particles are dispersed in a binder.

26. The device of claim 25, wherein the binder comprises a polymer binder.

27. The device of claim 1, wherein the at least one element comprises a body coated by a covering having at least one layer comprising the at least one substance.

28. The device of claim 27, wherein the at least one layer comprises a binder and the at least one substance.

29. The device of claim 28, wherein the at least one layer further comprises particles comprising a second substance.

30. The device of claim 27, wherein the body comprises a material configured to exert at least one of an electrical field and a magnetic field on the at least one of a cosmetic product and a care product.

31. The device of claim 1, wherein the at least one element defines one of a ring, a shutter, a tube, a polyhedron, and a parallelepiped.

32. The device of claim 31, wherein the at least one element defines at least one hole.

33. The device of claim 1, wherein at least one of the particles is electrically conductive.

34. The device of claim 33, wherein at least one of the particles comprises an electrically insulating core, an electrically conductive covering, and an intermediate layer between the core and the covering, wherein the intermediate layer is configured to confer electrical conduction properties to the core such that the covering can be deposited onto the core in an electrochemical manner.

35. The device of claim 1, wherein at least one of the particles is configured to generate a magnetic field.

36. The device of claim 1, wherein the at least one substance is configured to cause one of a catalytic reaction, an enzymatic reaction, and a modification of a composition of the at least one of a cosmetic product and a care product.

37. The device of claim 1, wherein the device is configured such that the at least one substance exerts at least one of an electrical field and a magnetic field on the at least one of a cosmetic product and a care product while the at least one of a cosmetic product and a care product is being dispensed.

38. The device of claim 1, wherein the at least one substance is configured to diffuse into the at least one of a cosmetic product and a care product.

39. The device of claim 38, wherein the at least one substance is configured to comprise an ionic form at least once it has diffused into the at least one of a cosmetic product and a care product.

40. The device of claim 1, wherein the at least one substance exhibits properties selected from at least one of purifying properties, antiseptic properties, blood circulation encouraging properties, regenerative properties, and healing properties.

41. The device of claim 1, wherein the at least one substance comprises at least one material selected from metals, metal alloys, cobalt, barium, chromium, aluminum, silver, copper, titanium, bronze, manganese, metal oxides, iron oxides, ferrites, silicates, sulfates, barium sulfates, carbonates, calcium carbonates, non-ferrous compounds, sulfur, magnesium, calcium, boron, potassium, carbon, oligoelements, sea salts, rock salts, clays, steatites, algaes, extracts of algaes, planktons, extracts of planktons, roots, licorices, gingers, waxes, oils, bactericides, vitamins, proteins, acids, hormones, collagens, alums, alum stones, silks, hemps, and glucoses.

42. The device of claim 1, wherein the at least one substance contacts at least one of a substrate and a binder comprising at least one material selected from silicas, coloidal silicas, sands, aluminas, steatites, sandstones, titanium oxides, zirconium oxides, glasses, ceramics, woods, corks, wood fibers, cork fibers, wood powders, cork powders, corns, maizes, wheat fibers, rice fibers, lavas, silicates, galenas, oxides, hemps, flaxes, silks, clays, porcelains, micas, polymers, thermoplastics, thermosetting polymers, PEs, PETs, PUs, PVCs, PAs, EVAs, vinyls, urea formaldehydes, epoxies, polyesters, cyanoacrylates, and elastomers.

43. The device of claim 1, wherein the at least one element is configured in the form of an applicator for the at least one of a cosmetic product and a care product.

44. The device of claim 43, wherein a portion of the at least one element defines a substantially convex surface.

45. The device of claim 1, wherein the at least one element is configured to be permeable to the at least one of a cosmetic product and a care product.

46. The device of claim 1, wherein the device is configured in the form of a single use device, wherein the at least one element is configured to be loaded with a single dose of the at least one of a cosmetic product and a care product, and wherein the device is configured to dispense the single dose.

47. The device of claim 1, wherein the inner space is configured to contain a supply of the at least one of a cosmetic product and a care product.

48. The device of claim 47, further comprising at least one housing configured to be free of the at least one of a cosmetic product and a care product and contain the at least one element while not in use.

49. The device of claim 48, further comprising a closure member configured to close the at least one housing in a substantially hermetic manner with the at least one element contained in the at least one housing.

50. The device of claim 1, further comprising at least one of a cosmetic product and a care product delivery orifice, wherein the device is configured to hold the at least one element against the at least one of a cosmetic product and a care product delivery orifice so as to substantially close the reservoir.

51. The device of claim 1, wherein the at least one element is configured to serve as a product stirrer for at least one of a cosmetic product and a care product.

52. The device of claim 1, further comprising a cup having an end wall, wherein the at least one element is located at the end wall of the cup.

53. The device of claim 1, wherein the at least one element is configured to define a housing configured to receive an applicator element and be in flow communication with the reservoir.

54. The device of claim 53, wherein the at least one element is configured to define a seat configured to bear against an applicator element.

55. The device of claim 1, wherein the device at least partially comprises a transparent material configured to enable a user to see the at least one element when the device is closed.

56. The device of claim 1, further comprising a valve member configured to selectively inhibit flow communication between the reservoir and the at least one element.

57. The device of claim 1, further comprising at least one of a cosmetic product and a care product contained in the reservoir.

58. The device of claim 57, wherein the at least one element is configured to be removably coupled to the reservoir.

59. The device of claim 58, wherein the at least one of a cosmetic product and a care product and the at least one element are in flow communication with one another when the at least one element is removably coupled to the reservoir.

60. The device of claim 57, wherein the at least one element is coupled to the reservoir via at least one of snap-fastening, screw-fastening, adhesives, and heat-sealing.

61. The device of claim 57, further comprising a capsule having a skirt, wherein the capsule is configured to close the reservoir and the at least one element is coupled to the skirt.

62. The device of claim 57, wherein the at least one element comprises a tube through which the product flows.

63. The device of claim 57, wherein the at least one element is configured such that the at least one of a cosmetic product and a care product from the reservoir passes through the at least one element when the device is used.

64. The device of claim 57, wherein the at least one of a cosmetic product and a care product comprises at least one cosmetic product in the form of at least one of a liquid, a powder, a gel, a cream, an aqueous solution, an alcohol solution, an oil, and an emulsion.

65. A method for at least one of applying at least one of a cosmetic and a care product to a surface and packaging the at least one of a cosmetic product and a care product, the method comprising:

providing the device of claim 57; and at least one of causing at least one of the at least one of a cosmetic product and a care product and the surface receiving the at least one of a cosmetic product and a care product to contact the at least one substance, and causing at least one of the at least one of a cosmetic product and a care product and the surface receiving the at least one of a cosmetic product and a care product to be subjected to the field generated by the at least one element.

66. A method of manufacturing the device of claim 1, the method comprising:

forming the at least one element; and removing material from the surface of the at least one element such that some of the particles are exposed.

67. The method of manufacturing of claim 66, wherein removing material from the surface of the at least one element comprises rotating the at least one element and an abrasive agent in a drum.

68. A device for at least one of applying at least one of a cosmetic product and a care product to a surface and packaging the at least one of a cosmetic product and a care product, the device comprising:

a reservoir containing the at least one of a cosmetic product and a care product; and at least one element comprising a plurality of particles, and a portion permeable to the at least one of a cosmetic product and a care product, the portion at least partially defining an inner space configured to retain the plurality of particles, wherein the portion permeable to the at least one of a cosmetic product and a care product contacts at least some of the plurality of particles, and wherein at least some of the plurality of particles contact each other, wherein the at least one element is configured such that the plurality of particles comprise at least one substance, and at least one of the at least one of a cosmetic product and a care product and the surface receiving the at least one of a cosmetic product and a care product is enabled to contact the at least one substance, and the device is configured such that the at least one of a cosmetic product and a care product is capable of penetrating the inner space configured to retain the plurality of particles; and/or the at least one element generates at least one of an electric field and a magnetic field, and at least one of the at least one of a cosmetic product and a care product and the surface receiving the at least one of a cosmetic product and a care product is enabled to be subjected to the field generated by the at least one element and wherein the particles differ from the at least one of a cosmetic product and a care product.

69. A device for at least one of applying at least one of a cosmetic product and a care product to a surface and packaging the at least one of a cosmetic product and a care product, the device comprising:

a reservoir containing the at least one of a cosmetic product and a care product; and at least one element comprising a plurality of particles, and a portion permeable to the at least one of a cosmetic product and a care product, the portion at least partially defining an inner space configured to retain the plurality of particles, wherein the portion permeable to the at least one of a cosmetic product and a care product contacts at least some of the plurality of particles, wherein the at least one element is configured such that the plurality of particles comprise at least one substance, and at least one of the at least one of a cosmetic product and a care product and the surface receiving the at least one of a cosmetic product and a care product is enabled to contact the at least one substance; and/or the at least one element generates at least one of an electric field and a magnetic field, and at least one of the at least one of a cosmetic product and a care product and the surface receiving the at least one of the cosmetic product and the care product is enabled to be subjected to the field generated by the at least one element, wherein the portion permeable to the at least one of a cosmetic product and care product defines at least one passage configured to pass the at least one of a cosmetic product and a care product therethrough, and wherein the particles define a size dimension sufficient to prevent the particles from traveling through the at least one passage and wherein the particles differ from the at least one of a cosmetic product and a care product.

70. A device for at least one of applying at least one of a cosmetic product and a care product to a surface and packaging the at least one of a cosmetic product and a care product, the device comprising:

a reservoir containing the at least one of a cosmetic product and a care product; and at least one element comprising a plurality of particles, and a portion permeable to the at least one of a cosmetic product and a care product, the portion at least partially defining an inner space configured to retain the plurality of particles, wherein the portion permeable to the at least one of a cosmetic product and a care product contacts at least some of the plurality of particles, wherein the at least one element is configured such that the plurality of particles comprise at least one substance, and at least one of the at least one of a cosmetic product and a care product and the surface receiving the at least one of a cosmetic product and a cosmetic product is enabled to contact the at least one substance, and the device is configured such that the at least one of a cosmetic product and a care product is capable of penetrating the inner space configured to retain the plurality of particles; and/or the at least one element generates at least one of an electric field and a magnetic field, and at least one of the at least one of a cosmetic product and a care product and the surface receiving the at least one of a cosmetic product and a cosmetic product is enabled to be subjected to the field generated by the at least one element, wherein the plurality of particles defines a volume and the portion permeable to the at least one of a cosmetic product and a care product defines a volume, the volume of the plurality of particles being greater than the volume of the portion permeable to the at least one of a cosmetic product and a care product and wherein the particles differ from the at least one of a cosmetic product and a care product.

71. The device of claim 1, wherein the permeable portion comprises two opposing walls and the plurality of particles is disposed between the two opposing walls.

72. The device of claim 1, wherein the plurality of particles is completely surrounded by the permeable portion.

73. The device of claim 1, wherein the permeable portion is flexible.

74. The device of claim 1, wherein the permeable portion is configured to retain at least some of the cosmetic product within the inner space defined by the permeable portion.

75. The device of claim 1, wherein the device is configured such that the reservoir and the at least one element are in flow communication with one another.

76. The device of claim 1, wherein the portion permeable to the at least one of a cosmetic product and a care product is not soluble with respect to the at least one of the cosmetic product and the care product.

77. The device of claim 1, wherein the at least one element and the at least one of a cosmetic product and a care product are not in permanent communication with one another at least prior to use of the device.

* * * * *

UNITED STATES PATENT AND TRADEMARK OFFICE

CERTIFICATE OF CORRECTION

PATENT NO. : 7,040,827 B2
APPLICATION NO. : 10/304084
DATED : May 9, 2006
INVENTOR(S) : Jean-Louis H. Gueret It is certified that error appears in the above-identified patent and that said Letters Patent is hereby corrected as shown below:

In claim 1, column 36, line 66, “a cosmetic product is” should read --a care product is--.

In claim 1, column 37, line 1, “element and” should read --element, and--.

In claim 68, column 41, line 22, “element and” should read --element, and--.

In claim 69, column 41, line 59, “passage and” should read --passage, and--.

In claim 70, column 42, line 19, “a cosmetic product is” should read --a care product is--.

In claim 70, column 42, line 28, “a cosmetic product is” should read --a care product is--.

In claim 70, column 42, line 36, “care product and” should read --care product, and--.

Signed and Sealed this

First Day of August, 2006

JON W. DUDAS
*Director of the United States Patent and Trademark Office*